US007931157B1

(12) United States Patent
Palumbo

(10) Patent No.: US 7,931,157 B1
(45) Date of Patent: Apr. 26, 2011

(54) COMPACT COLLAPSIBLE BINS FOR VIEWING AND STORING SHEET GOODS

(76) Inventor: John A. Palumbo, Evergreen, CO (US)

( * ) Notice: Subject to any disclaimer, the term of this patent is extended or adjusted under 35 U.S.C. 154(b) by 741 days.

(21) Appl. No.: 11/725,305

(22) Filed: Mar. 19, 2007

Related U.S. Application Data

(60) Provisional application No. 60/787,413, filed on Mar. 30, 2006, provisional application No. 60/814,118, filed on Jun. 17, 2006.

(51) Int. Cl.
*A47F 1/04* (2006.01)

(52) U.S. Cl. ..... 211/70.1; 211/50; 211/72; D9/455; 248/174; 248/152

(58) Field of Classification Search ..... 211/189, 211/195, 70.1, 72, 73, 41.15, 50, 49.1, 11; 206/756, 765, 425; D6/454, 480; D9/433, D9/432, 431, 430, 455; 220/4.28, 4.29; 248/459, 248/174, 152
See application file for complete search history.

(56) References Cited

U.S. PATENT DOCUMENTS 1,006,328 A * 10/1911 Widenhofer ..... 211/195
1,056,183 A * 3/1913 Kilovitz ..... 248/459
1,436,337 A * 11/1922 Burger ..... 206/762
1,565,672 A * 12/1925 Rhodes ..... 211/133.6
1,838,681 A * 12/1931 Hutchings ..... 211/50
1,918,712 A * 7/1933 Myers ..... 248/450
2,258,666 A * 10/1941 Walker ..... 211/11
2,289,070 A * 7/1942 Ralston ..... 211/11
2,350,266 A * 5/1944 Wolters ..... 206/425
2,374,390 A * 4/1945 Snyder ..... 229/112
2,559,489 A * 7/1951 Wolf ..... 40/539
2,615,589 A * 10/1952 Perdue ..... 217/12 R
2,788,596 A * 4/1957 Schwartz ..... 40/124.18
2,829,651 A * 4/1958 Loring ..... 211/42
3,164,254 A * 1/1965 Gorc ..... 211/42
3,232,439 A * 2/1966 Dahl, Jr. ..... 211/10
3,314,530 A * 4/1967 Michalka ..... 206/756
3,370,701 A * 2/1968 Van Acker et al. ..... 206/425
3,464,565 A * 9/1969 Nevai ..... 211/42
3,674,328 A * 7/1972 White et al. ..... 312/263
3,955,320 A * 5/1976 Serovy et al. ..... 47/66.1
4,198,105 A * 4/1980 Gibbs ..... 312/183
4,241,921 A * 12/1980 Miller ..... 273/148 A
4,279,455 A * 7/1981 Santo ..... 312/348.2
5,318,190 A * 6/1994 Mason ..... 211/41.2
5,322,008 A * 6/1994 Dixon ..... 100/34
5,372,256 A * 12/1994 Chen ..... 206/425
5,472,098 A * 12/1995 Ho ..... 211/2
5,529,187 A * 6/1996 DeNola ..... 206/449
5,561,947 A * 10/1996 Greenarch et al. ..... 47/76

(Continued)

OTHER PUBLICATIONS

ASW, Express—Print Racks (Feb. 17, 2007).

(Continued)

*Primary Examiner* — Darnell M Jayne
*Assistant Examiner* — Devin Barnett
(74) *Attorney, Agent, or Firm* — James K. Poole, Esq.

(57) ABSTRACT

Display bins for sheet goods which are easily assembled and disassembled are formed of bottom panels, front and rear display panels for holding sheet goods at suitable angles from the vertical for display. The front and rear display panels can be removably attached to both the bottom panel and at least two support brackets for use. All the components can be separated and stacked in a flat package for shipment or storage.

10 Claims, 36 Drawing Sheets

U.S. PATENT DOCUMENTS 5,803,561 A * 9/1998 Puehlhorn ..... 312/264
5,819,922 A * 10/1998 Martin, Jr. ..... 206/214
5,868,373 A * 2/1999 Duff ..... 248/459
5,974,707 A * 11/1999 Kowalczyk ..... 40/124.4
6,161,704 A * 12/2000 Stravitz ..... 211/45
6,357,194 B1 * 3/2002 Jones, Jr. ..... 52/590.1
6,497,018 B1 * 12/2002 Chiu et al. ..... 27/2
7,077,269 B2 * 7/2006 Kissell ..... 206/446
2002/0178669 A1 * 12/2002 Harambasic et al. ..... 52/264
2004/0188588 A1 * 9/2004 Smith ..... 248/459
2007/0169429 A1 * 7/2007 Wu et al. ..... 52/405.4

OTHER PUBLICATIONS

Art City Alvin Print Racks (Apr. 1, 2006).
Fine Art Store Ambrosia Print Rack (Apr. 1, 2006).
Hi-View Assembly Instructions Tools Needed/Hardware.

* cited by examiner

COMPACT COLLAPSIBLE BINS FOR VIEWING AND STORING SHEET GOODS

CROSS-REFERENCE TO RELATED APPLICATIONS

This application claims priority from Applicant's provisional applications U.S. Ser. No. 60/787,413 (filed Mar. 30, 2006) and U.S. Ser. No. 60/814,118 (filed Jun. 17, 2006)

BACKGROUND OF THE INVENTION

1) Field of the Invention

This invention relates to compact collapsible or foldable bins which display individual sheets of materials such as art for viewing. It is a bin that holds sheets of art to view, assembles in less than a minute and is easily transported. It can be made of materials that are light and hard.

2) Discussion of Related Art

Currently art-viewing bins are bulky, heavy wooden or welded metal structures which require bolts, screws and tools to assemble multiple piece constructions.

Art bins have been popular for many years, serving both artists and customers at art galleries, art fairs and art shows throughout the world.

In almost all cases, displaying unframed Art requires large and heavy display units which take up too much space, limiting the amount of art which can be displayed for sale. These displays are not cost effective and do not complement the surroundings or the art being sold. They do not display a sufficient amount of art to justify the high cost of retail space or booth rentals.

Screwdrivers, wrenches and a hammer are usually required to disassemble the displays at the store or gallery, then to assemble them at the show, then disassemble them again when the show is over and finally to reassemble them upon return to the Gallery. An art gallery averages five to six shows a year and some dealers average twenty to thirty shows per year, owning and using several of these cumbersome displays that take up to thirty minutes or more each to assemble or disassemble.

Thus, costly and time-consuming art displays have dominated the art Industry until a suitable alternative has been developed. The present invention, a compact, collapsible or foldable bin for displaying individual sheet goods, resolves all these cumbersome problems.

SUMMARY OF THE INVENTION

The present invention overcomes at least twelve problems associated with prior art products. The five-piece art bin is light in weight with a very sturdy, strong design even when using the lightest materials. It is easy to assemble and disassemble, compact for transporting, inexpensive, has as few as five pieces, uses no screws or bolts, and requires no tools for assembly or disassembly. The bin holds an unlimited amount of art or other sheet goods, costs less to ship then conventional bins, and looks like a piece of art itself.

The five-piece art bin (one embodiment) has a base comprising two support brackets.

When viewing these support brackets from a side-view two substantially straight-edged portions inclined from the horizontal and leading upward extend to the right and left. The inclined straight edges are inclined at acute angles from the horizontal on each side to support display panels, the angles being sufficient to make sheet goods displayed in the same plane visible from above and to the side, but not reaching an excessive point which may adversely affect the stability of the assembled art bin.

The support bracket portion to the left and the portion to the right can be separated by a gap or connecting portion that can be about three or more inches in width and one or more inches high.

The support bracket portion to the left and the portion to the right each incorporate a male dove tail finger cut along the length of the leading edges of both of left and right portions of the two support brackets used for assembling the art bin.

The length, height and width of the support brackets may vary in size. The distance separating the left and right portions of the two support brackets can vary according to their sizes and the sizes of the two panels, which may be referred to as front and rear panels. These two panels, which can vary in shape and size, support the art for viewing. The two "front and rear" panels have a horizontal lower edge, angled or chamfered at the bottom of each panel. On the backsides or undersides of the two panels are two female dove tail slots or grooves that start at selected positions at the top left and right of each panel and travel the length of the panel from top to bottom. The distance between the two female dovetail grooves varies according to the sizes of the two panels.

The bottom base panel has a substantially rectangular shape having two horizontal side edges with chamfers on both sides that extend the length of the panel. The chamfers on the bottom based panel sides and the lower edges of the display panels are cut so that the two chamfered surfaces match up to position the display panel at a suitable acute angle from the horizontal, thus forming an obtuse angle where they intersect the base panel. This panel faces upward and lies across the two perpendicular support brackets separated by a gap of the two male dove tailed leading edges of the angled portions to the left and right sides of the support brackets.

The front and rear panels with two female dove tail slots starting at the top left and top right of each display panel that travel the length of the panel from top to bottom, slide down the length of the angled portions to the left and right of the support brackets, which incorporate a male dove tail finger protruding along the length of the upper edges of the two support brackets. The front and rear panels thus hold the bottom base rectangle panel in place.

This art bin can be manufactured in various sizes, styles and shapes, with numerous colors and finishes. The display panels are designed with the area and strength to hold suitable quantities of the sheet goods for which designed, but additionally can have upper contours to enhance the esthetic appearance of the assembled bins. Thus, in addition to substantially rectangular shapes, the panels can have the corners cut off at angles to produce a trapezoidal or "hex" shape, half-round or compound-curved tops which might be termed "half-dome" shapes, intersecting arcs producing an 'arch" appearance, and other suitable shapes. Various suitable materials can be employed in forming the planar components of the bins, including wood (solid, plywood or veneers), lightweight metals, plastic composites, heavy duty cardboard or pasteboard with suitable finishes, and even sheets of semi-rigid foamed plastics. A preferred embodiment has components of thin sheets of high quality wood with a furniture-style finish to complement art works displayed and stand out in the most distinguished gallery. The art bin solves many problems because of its compactness and weight reduction, thus costs considerably less when shipping. The art bin is inexpensive, can have as few as five pieces, requires no screws or bolts, needs no tools to assemble or disassemble, holds an essentially unlimited amount of art, costs less to ship and looks like a work of art itself. The "collapsible" bins disclosed and claimed herein can be folded and/or disassembled into a substantially flat assembly or group of components for convenient shipment and storage.

In accordance with the present invention, A collapsible display bin for display of sheet goods, comprising first and second display panels having designated upper and lower edges and support means for maintaining these display panels in positions wherein the panels are each inclined at acute angles from the horizontal, thereby displaying sheet goods effectively on at least one of the panels while creating a stable structure, with the lower edges and planes of the panels including an obtuse angle therebetween. The acute angles of the panels from the horizontal can be in a range of from about 40 to about 55 degrees, preferably from about 45 to about 50 degrees, and most preferably about 49 degrees. The two panels can have either symmetric or different acute angles within these ranges.

The support means mentioned can comprise at least one substantially triangular support bracket foldably attached to the lower surface of each of the panels to support the panels in inclined positions when extended in a direction approximately perpendicular to the lower surfaces of the panels to contact a horizontal surface and the lower edges of the panels are foldably attached to each other. In this embodiment of the display bin, the panels and support brackets can be folded inward to form a flat assembly for storage or transport. To accomplish this, the panels and support brackets are interconnected with a material which permits them to be disassembled for storage or transport. All of the components, comprising bottom panels, display panels and support means of various types, are planar preferably components which can be stacked and packed in a flat package when disassembled.

Another embodiment of the above provides for the lower edges of the panels to be foldably attached to the edges of a rectangular base panel, thus forming a gap between the inclined panels of the assembled bin to provide additional space for sheet goods. In either embodiment, support means can comprise at least two support brackets foldably attached to the lower surfaces of each of the panels.

Another embodiment of the display bin comprises at least one flat bottom panel, first and second display panels which are adapted to be removably attached to this bottom panel, and support brackets for maintaining the display panels in inclined position when removably attached to the bottom panel. The first and second display panels can be removably attached to these support brackets at predetermined acute angles from the horizontal to provide support and display surfaces for sheet goods. Preferably, the support brackets comprise at least two support brackets which are removably attached to each of the panels and to the bottom panel. These support brackets can each comprise first and second angled portions to support the panels in inclined positions, and can be attached to the bottom panel by mechanical means. Further in accordance with the invention, the angled portions of these support brackets can be separated by a gap substantially parallel to the lower edges of the brackets to support the inclined panels with their lower edges separated to provide additional space for sheet goods. The first and second display panels can be attached to the bottom panel by insertion of their lower edges into slots along the edges of the bottom panel. For example, the panels can have male dovetail fingers cut on the bottom edges thereof, adapted for insertion into female dovetail slots in the bottom panel by sliding. In this arrangement, the support brackets can also be attached to the lower surfaces of said panels by insertion of the upper edges of the brackets into slots in the lower surfaces of the panels. Preferably, the support brackets, display panels and base panel are all interconnected by dovetail finger joints.

Further in accordance with the invention, the display bin described above can comprise a bottom panel which further comprises edge supports attached to the edges thereof at acute angles to the bottom panel to form a trough form, with the first and second display panels mechanically attached to the upper edges of these edge supports. Preferably, these edge supports are removably attached to the bottom panel. These parts—the bottom panel, edge supports, display panels and support brackets—can be interconnected by dovetail finger joints or other suitable tongue and groove joints.

As an alternative to one-piece support brackets comprising two angled portions each, the display bins discussed above can employ at least two, and preferably at least four, support brackets of substantially triangular form which are removably attached to the side edges of a bottom panel by insertion of their lower edges into slots along the edges of the bottom panel. The brackets and base slots can be configured to form dove tail joints. One version of this embodiment provides for a bin with a bottom panel is provided which is substantially rectangular and comprises substantially triangular portions along each side edge to serve as support brackets, with slots parallel to these edges at the bases of these triangular portions to receive and support the display panels.

In another embodiment, a collapsible display bin for sheet goods comprises at least one flat bottom panel, first and second display panels, having designated upper and lower edges, which are adapted to be removably attached to the at least one bottom panel, and at least two support bracket assemblies, each having two angled portions for supporting the display panels at suitable acute angles from the plane of the bottom panel, wherein the bottom panel, display panels and angled portions for the support bracket assemblies are all removably interconnected by dovetail finger joints. Further in accordance with this embodiment, the bottom panel can comprise edge supports attached to the longitudinal edges thereof at acute angles from the plane of the bottom panel by dovetail finger joints, with the first and second display panels attached to the upper edges of these edge supports by dovetail finger joints and supported by the angled portions of these support bracket assemblies. The edge supports attached to the longitudinal edges of the bottom panel at acute angles to the bottom panel form a sort of trough, and the first and second display panels can be attached to the upper edges of these edge supports. The edge supports can be removably the longitudinal edges of the bottom panel, and the bottom panel, display panels and support brackets can be interconnected by dovetail finger joints.

Further objects, aspects and advantages of the claimed embodiments will become apparent from perusing the following detailed description, including the appended claims, and the following drawings.

DETAILED DESCRIPTION OF PREFERRED EMBODIMENTS

Firstly, the components of the various embodiments of the invention disclosed and illustrated herein may be described as having upper and lower surfaces and/or edges or first and second surfaces and/or edges, using a terrestrial frame of reference where "top" or "upper" surfaces and the like are opposite the surface of the earth from which the force of gravity attracts objects, assuming that the components are assembled and the embodiments are placed in their normal positions for use. Also, in some cases the embodiments and/or their components can be described as having "front" and "rear" portions according to the direction from which the embodiments and the sheet goods displayed therein are intended to be viewed, as well as "first and second" portions. Where used, the expression "and/or" is used in the sense of meaning A, B or A+B. The term is a shorthand form used to mean that either A or B or both can be present. In various figures, some components of the invention may be omitted or unlabeled for clarity.

While the preferred embodiments herein are discussed in terms of the display of art works such as prints, lithographs, maps and charts, whether framed or unframed, these devices are equally suitable for supporting and displaying sheet goods in general for storage, sale or exhibit. For example, they may be used or adapted for the display of carpets or carpet samples, floor and/or wall coverings such as tiles or wallpaper, counter top coverings such as laminated plastic sheeting, hardwood veneers, thin plywood with veneer layers, materials for crafts and modeling such as sheet balsa wood, sheet plastics (solid or foamed) and the like. Other art items which can be displayed include photographic prints, stained or ornamental glass, paintings on paper, canvas or other media, marquetry and other ornamental wooden sheet goods. Various embodiments of suitable sizes can be used for convenient storage of publications for sale or papers in process in various office or business settings as well as "arts and crafts" environments.

All of the bins described herein, comprising support brackets, support bases and display panels, can be used on any automotive vehicle, including Jeeps, trucks, or trailer beds or roof tops to haul materials. It can also be used on flatbed trucks, in lumberyards or in warehouses to store, hold or haul any type of sheet like materials.

Figure 1A:
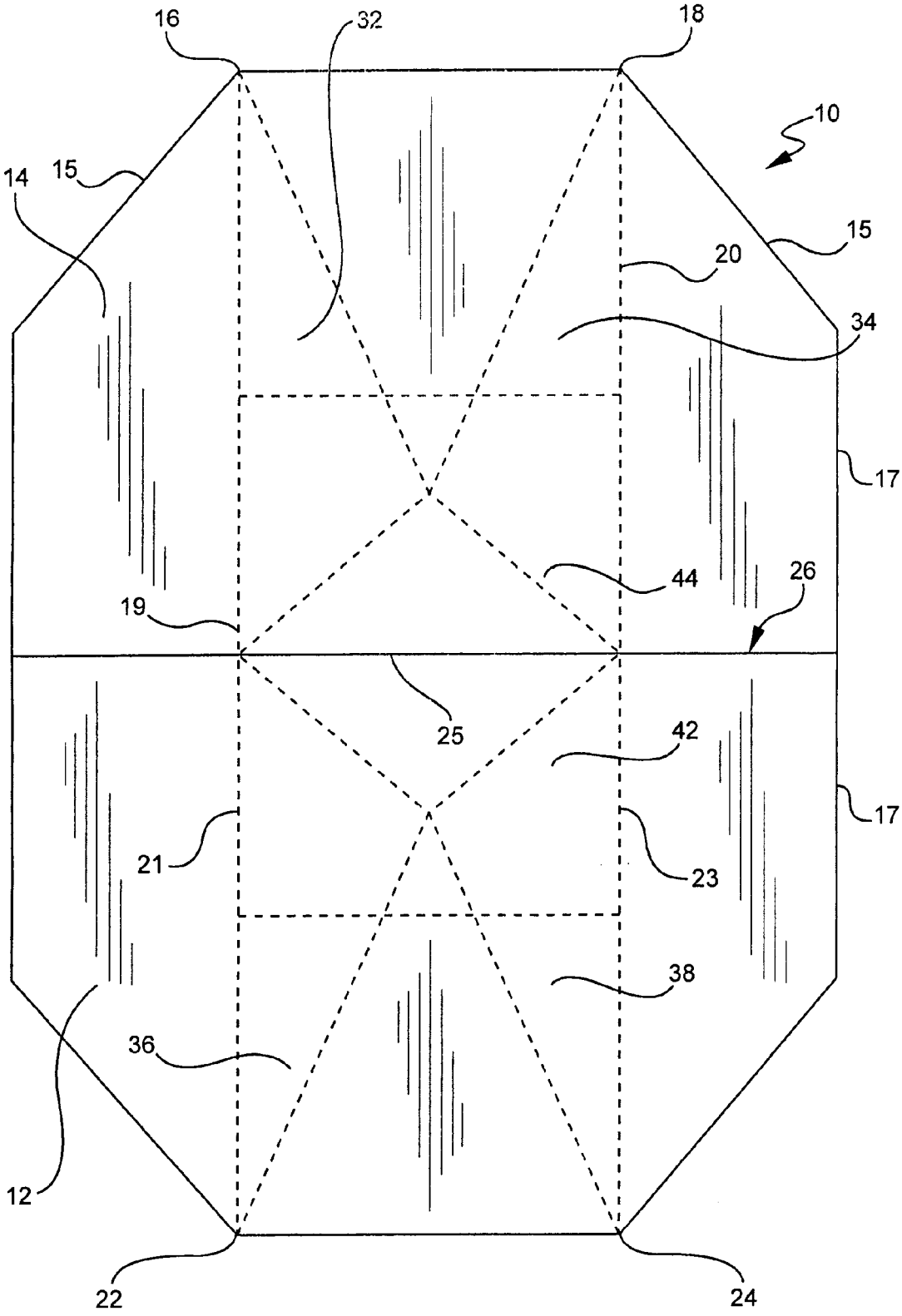
FIG. 1A is a top view of a "V" shaped folding art bin set up for use.

Turning now to the drawings, FIG. 1A is a top view of a one-piece collapsible or folding "V" style art bin 10 comprising eight interconnected sections.

Two display panels 12 and 14, which can be characterized as "front and rear" or simply "first and second" depending upon design and arrangement, can support sheet materials such as art prints (not shown here) for viewing and/or storage. The panels shown have substantially trapezoidal shapes, forming top corners 16 and 18 for panel 14 and top corners 22 and 24 on panel 12. The edges of the upper portions of panels 12 and 14 are cut at angles of approximately 35 degrees with respect to edges 17. The shapes of these panels can of course have any contours suitable for the intended use of the bin and esthetic considerations. Both front 12 and rear 14 panels are joined (26) horizontally at the bottom to form a "V" shape by means of a pliable, interlocking, flexible material that can be used as a hinge. Various suitable materials can be used for this joint, including conventional hinges, hook-and-loop fabric combinations such as Velcro™, heavy fabrics, pliable plastic materials and other suitable materials.

Figure 1B:
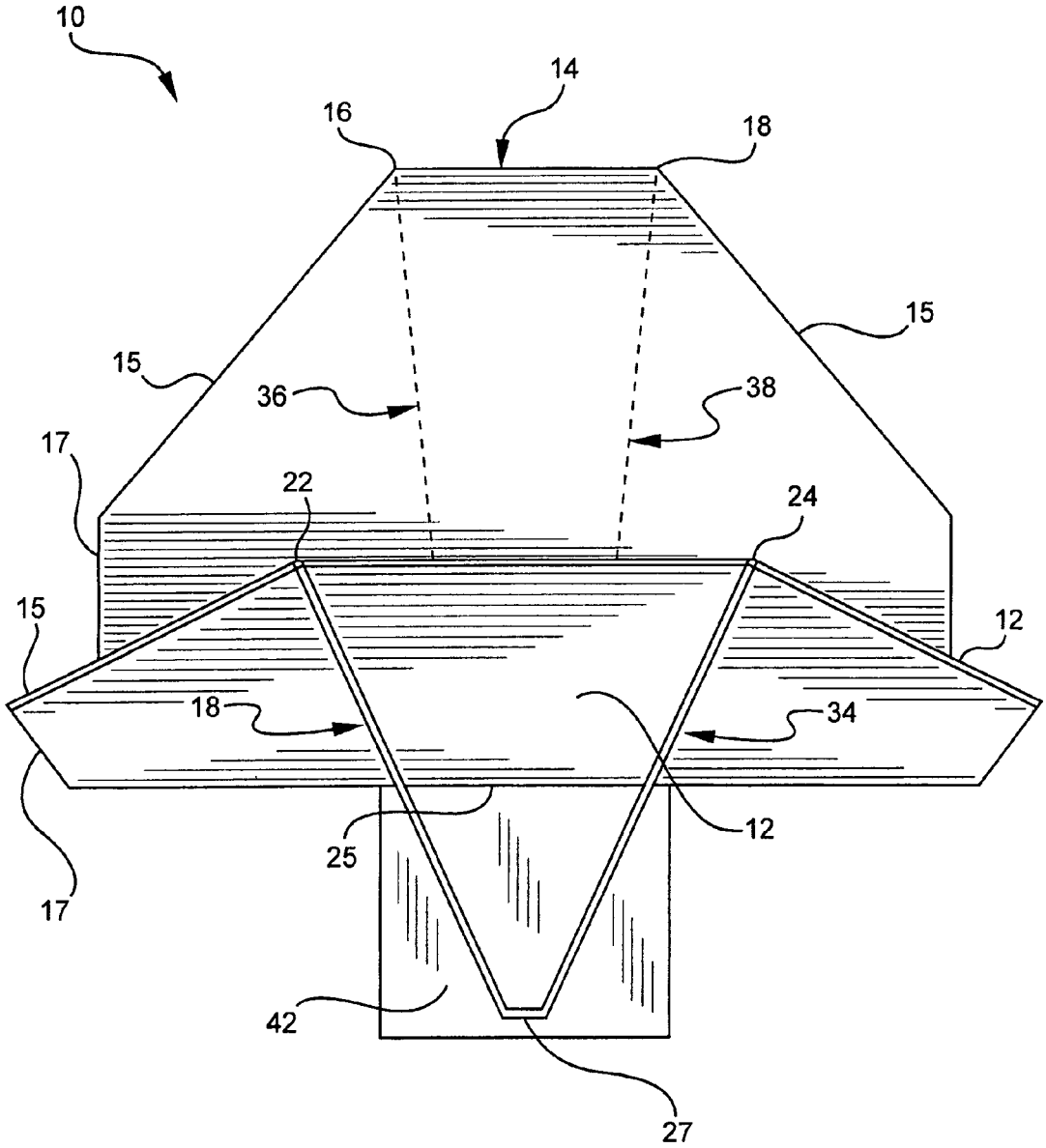
FIG. 1B is a side perspective view of the bin of FIG. 1A showing support brackets joined at the bottom corners.
Figure 1C:
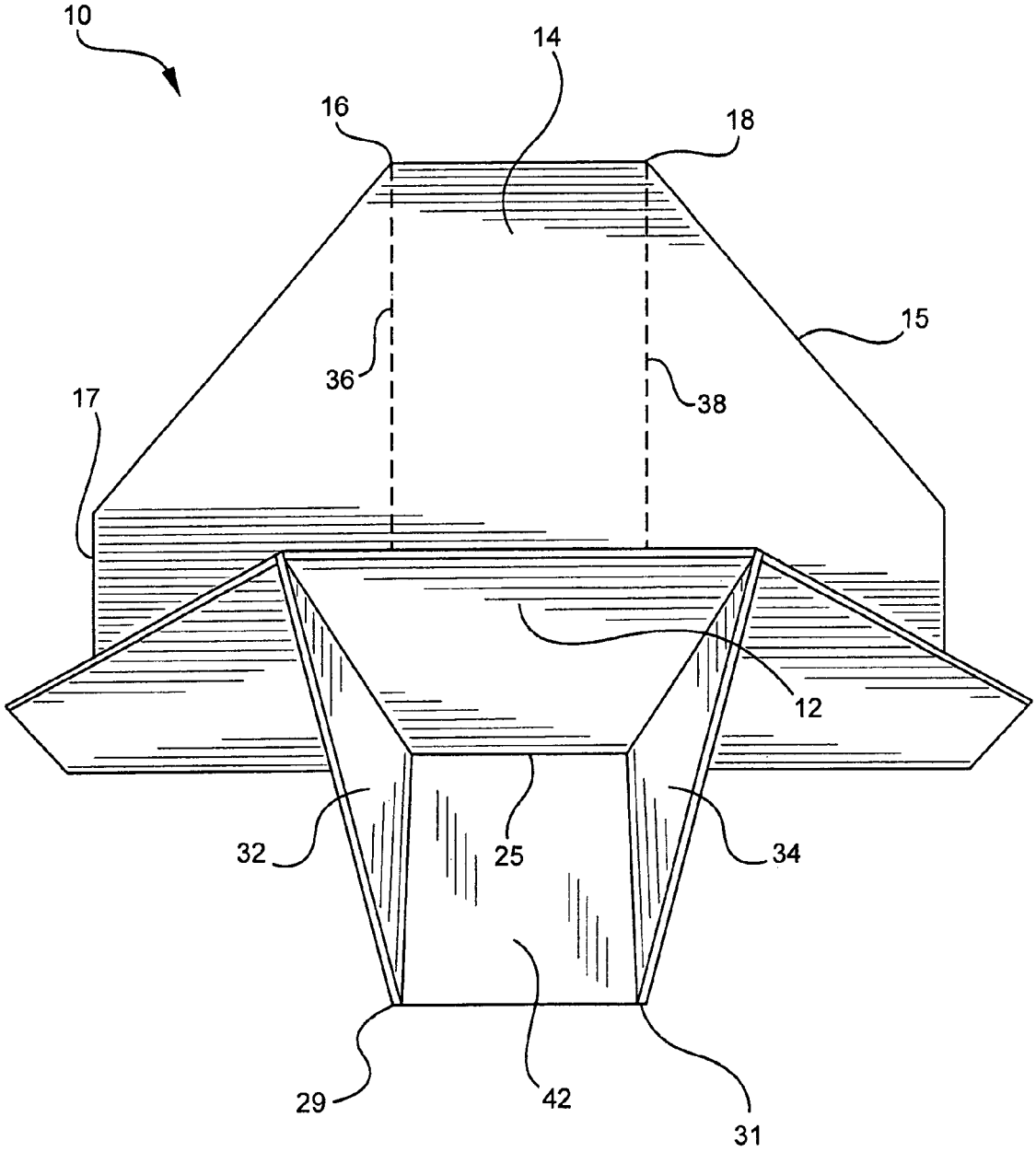
FIG. 1C is a side perspective view of the bin of FIG. 1A with the support brackets perpendicular to the display panels.

The four support brackets (32, 34, 36, 38) are preferably right triangles, and are best seen in FIGS. 1B and 1C, although shown schematically in dotted lines in FIG. 1A. Two support brackets (32 and 34) are hinged vertically to the backside of the panel 12 along lines 19 and 20 and then two additional support brackets (36 and 38) are hinged vertically to the backside of panel 14 along lines 21 and 23. Horizontal brace support 42 is hinged to the back bottom center of the panel 12 along line 25 and brace support 44 is hinged at the back bottom center of panel 14, also along line 25, and can be used in two ways to brace panel 12 and panel 14 in positions which form suitable acute angles with respect to the horizontal.

FIG. 1B provides a side perspective view of an assembled bin 10 in which the two sets of support brackets (32, 34 and 36, 38) rest on top of brace support 42, which is hinged at the back bottom centerline (25) of panel 12 and brace support 44, which is also hinged at the back bottom centerline (25) of panel 14. The support brackets (32, 34 and 36, 38) in this configuration are angled inward so that the bottoms of the two sets of support brackets can be attached together at 27 by any suitable mechanical attachment means in the foreground of FIG. 1B. The two sets of support brackets (32, 34 and 36, 38) are used to support panel 12 and panel 14.

FIG. 1C is a side perspective view of the bin 10 in a different configuration. The nearest set of support brackets (32 and 34) are in vertical positions substantially perpendicular to panel 12 and attached at their bottom edges by means of a pliable, interlocking, flexible material (not visible here) to the sides (29,31) of brace support 42, which is hinged at the back bottom centerline 25 of panel 12. The second set of support brackets (36 and 38, shown in dotted lines) are also vertical and attached by means of a pliable, interlocking, flexible material to the sides of brace support 44 (not seen here; see FIG. 1E), which is hinged at the back bottom centerline 25 of the panel 14.

Figure 1D:
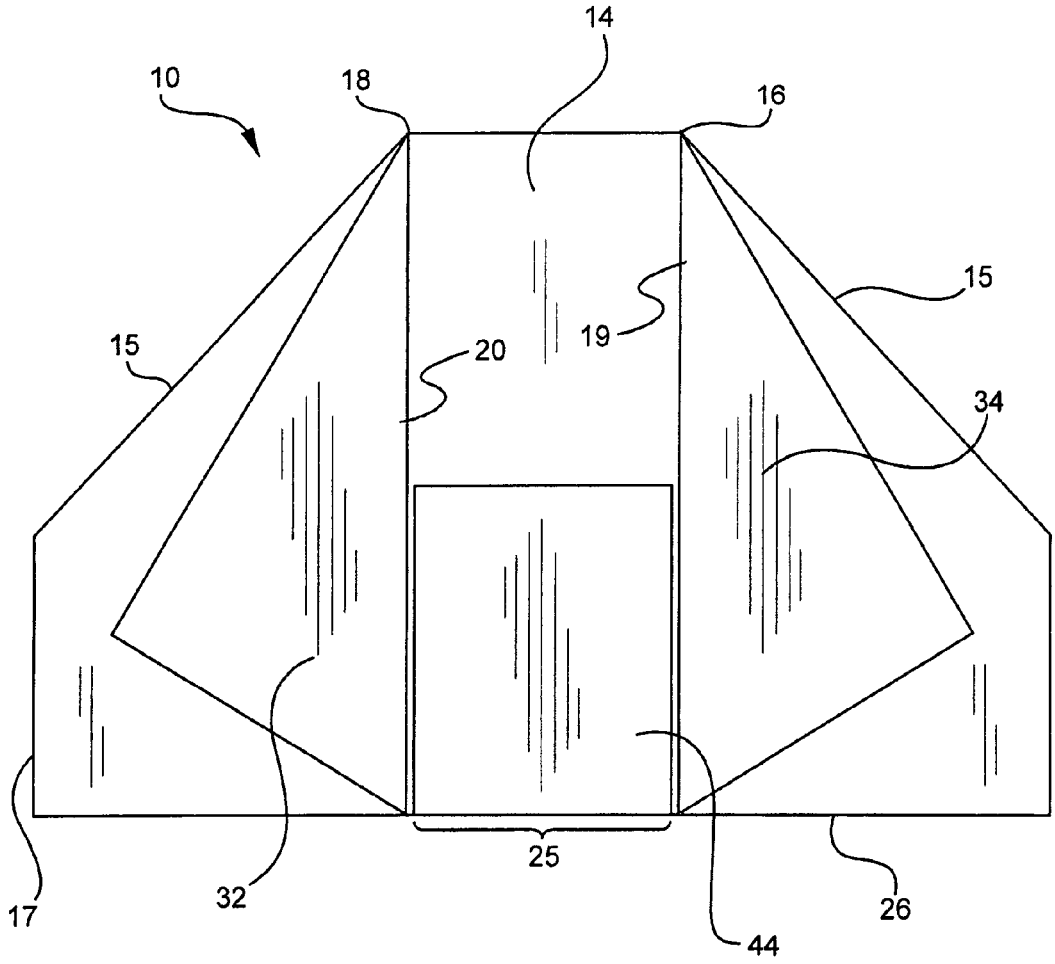
FIG. 1D is a side view of the bin of FIG. 1A folded for transport or storage.

FIG. 1D is a plan view of one side of the collapsible "V" shaped folding art bin 10 folded flat for storage or transport. This embodiment of the invention is a complete one piece art bin which can fold flat to an overall thickness of approximately a half inch to one inch, depending on the dimensions of the material used for construction. When the various components are removably attachable via the hinge materials, the components can be separated for even more compact storage.

Figure 1E:
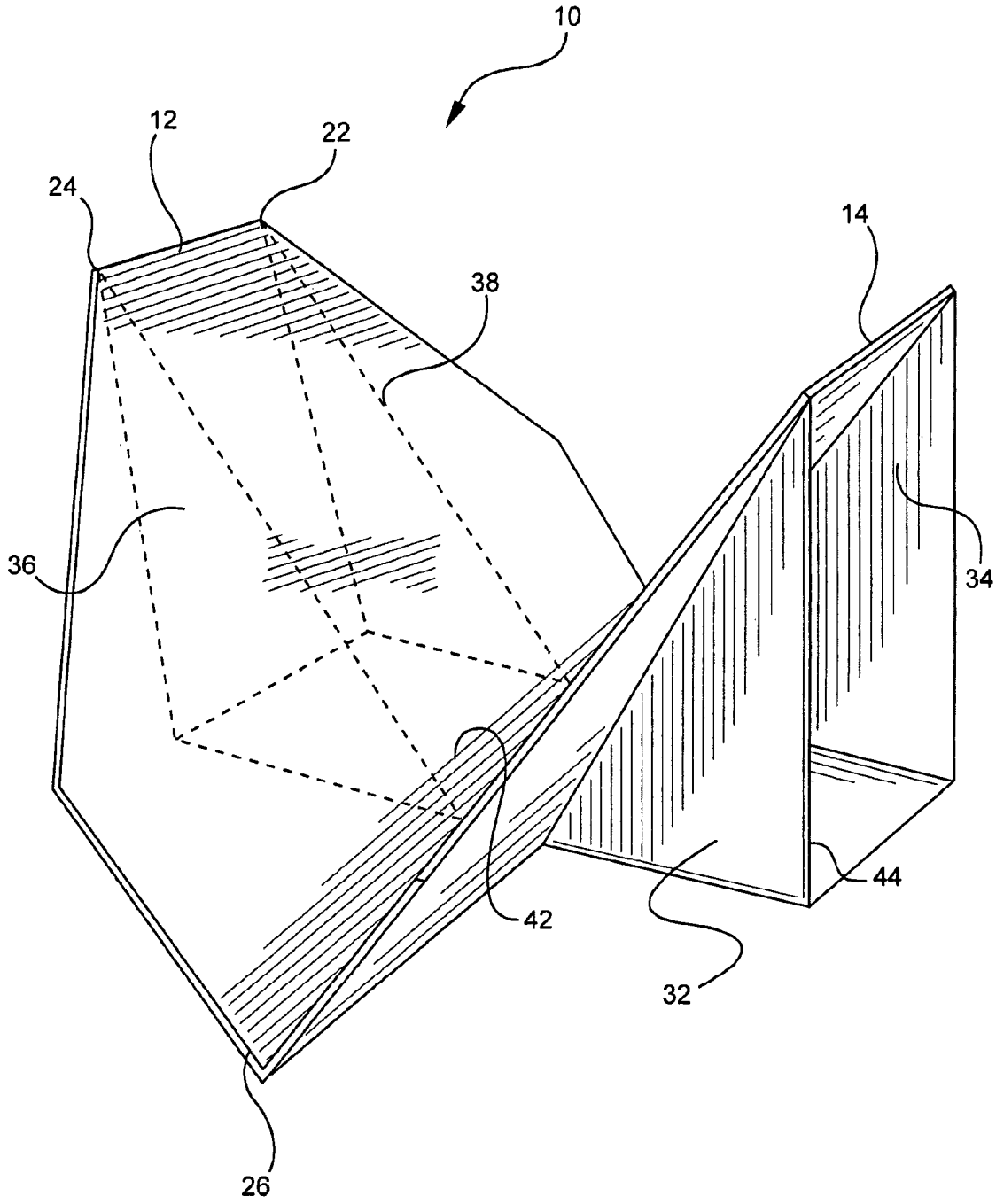
FIG. 1E is an end perspective view of the bin of FIG. 10.

FIG. 1E is a side perspective view of the "V" folding art bin 10 set up for use, showing the attached panel 14 hinged to support bracket 32 and support bracket 34 used to support panel 14. The arrangement is the same for the panel 12 components, with support brackets 36 and 38 used to support panel 12. It also shows brace supports 42 and 44, which can optionally be removed depending upon the style chosen to use, supporting the support brackets either as vertical support brackets or angled inward, or not used at all.

Figure 2A:
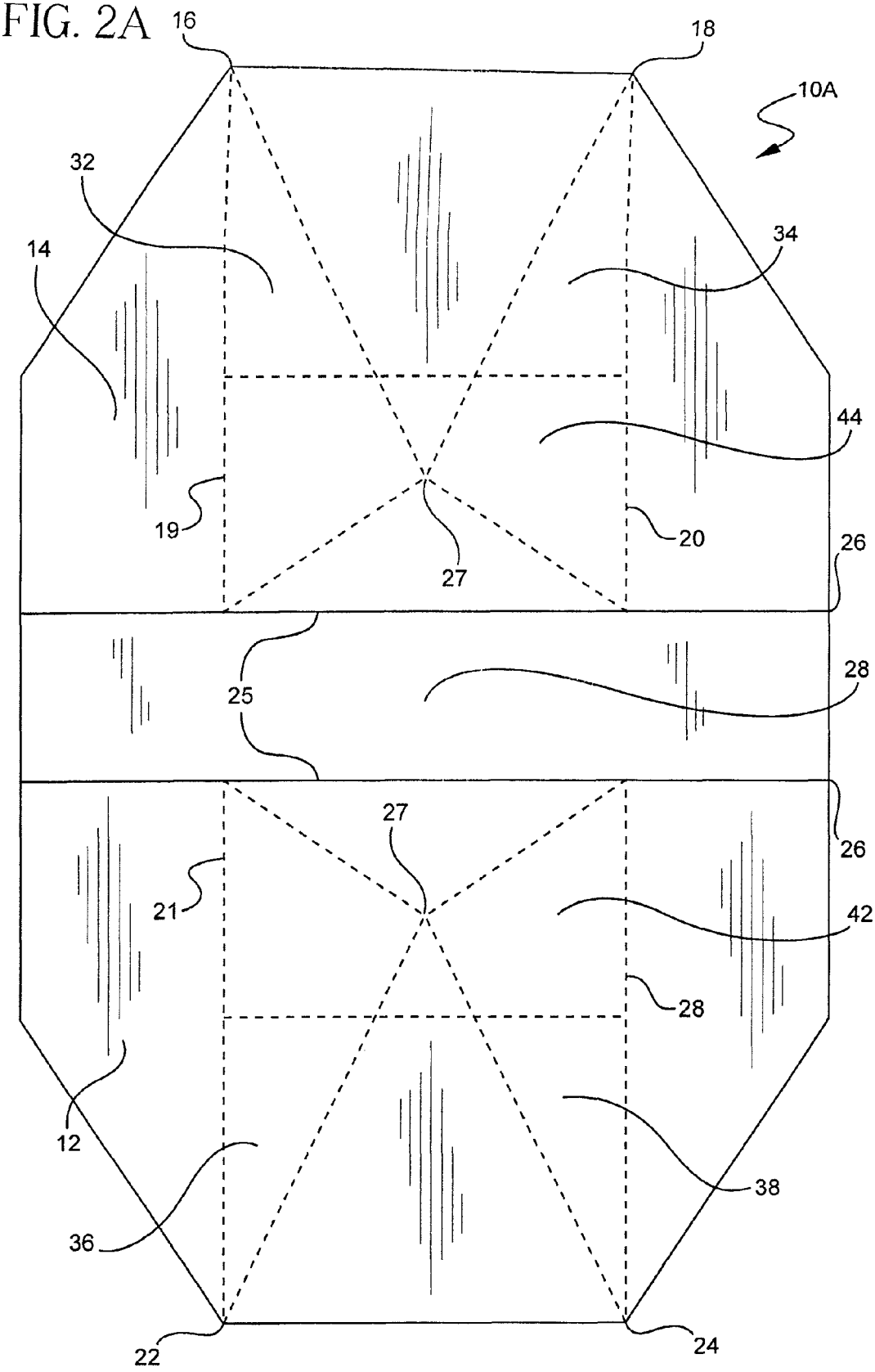
FIG. 2A is a top view of a flat bottom folding art bin unfolded for use.

FIG. 2A is a top view of a one-piece collapsible "U" style art bin 10A comprising eight components. The trapezoidal panels 12 and 14 support the art for viewing, as described above for the "V" style embodiment. The panels' top corners 16, 18, 22 and 24 are cut at approximately 35 degree angles to the sides of the panels 14 and 12, respectively. Both panels 12 and 14 are joined to a bottom central panel 28 along lines 26 by means of a pliable, interlocking, flexible material that can be used as a hinge, forming a "Flat Bottom U shape" for the bin when set up. This embodiment is essentially identical to that described above in FIGS. 1A through 1E except for the use of bottom panel 28 to provide extra space for sheet goods placed upon the display panels, and for the interconnection of separate components in a hinged manner so that they can be easily joined and disassembled. The four support brackets (32, 34, 36, 38) are preferably right triangles.

Two support brackets 32 and 34 are hinged vertically to the backside of panel 14 along lines 19 and 20 and two support brackets 36 and 38 are hinged vertically to the backside of panel 12 along line 21 and 23, using similar flexible materials. FIG. 2A shows these support brackets folded inward and joined at points 27 as in FIGS. 1A and 1B, while FIG. 2B shows the brackets arranged approximately perpendicular to panels 12 and 14 as well as brace supports 42 and 44.

Brace support 42 is hinged at the back bottom center of the panel 12 and brace support 44 is hinged at the back bottom center of panel 14, both along lines 25, and can be used in two different ways to brace the panels 12 and 14 in position, as discussed above with regard to FIGS. 1B and 1C. The various components of the bin are hinged or fastened together so that they can be folded flat for storage or transport as in FIG. 1D.

Figure 2B:
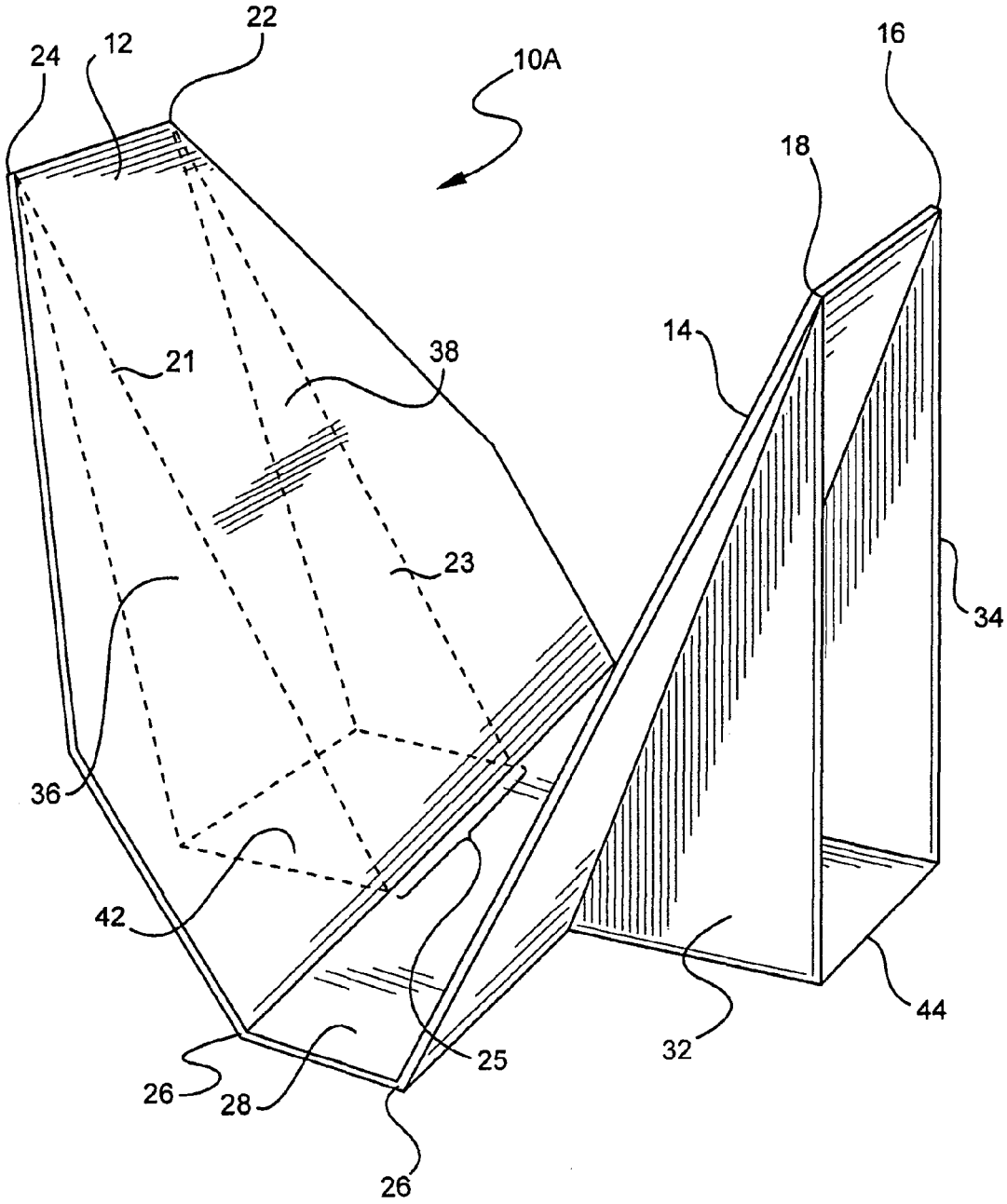
FIG. 2B is an end perspective view of the bin of FIG. 2A.

FIG. 2B is an end perspective view of an assembled "U" style folding art bin 10A showing the attached panel 14 hinged to support brackets 32 and 34, which are used to support panel 14. The arrangement is the same for the panel 12 components attached to support bracket 36 and support bracket 38, which are used to support the panel 12. It also shows the optional brace supports 42 and 44, which can be removed.

Depending upon the style chosen for use, the support brackets can be positioned as vertical support brackets approximately perpendicular to the panels or angled inward to serve the same function.

Figure 3A:
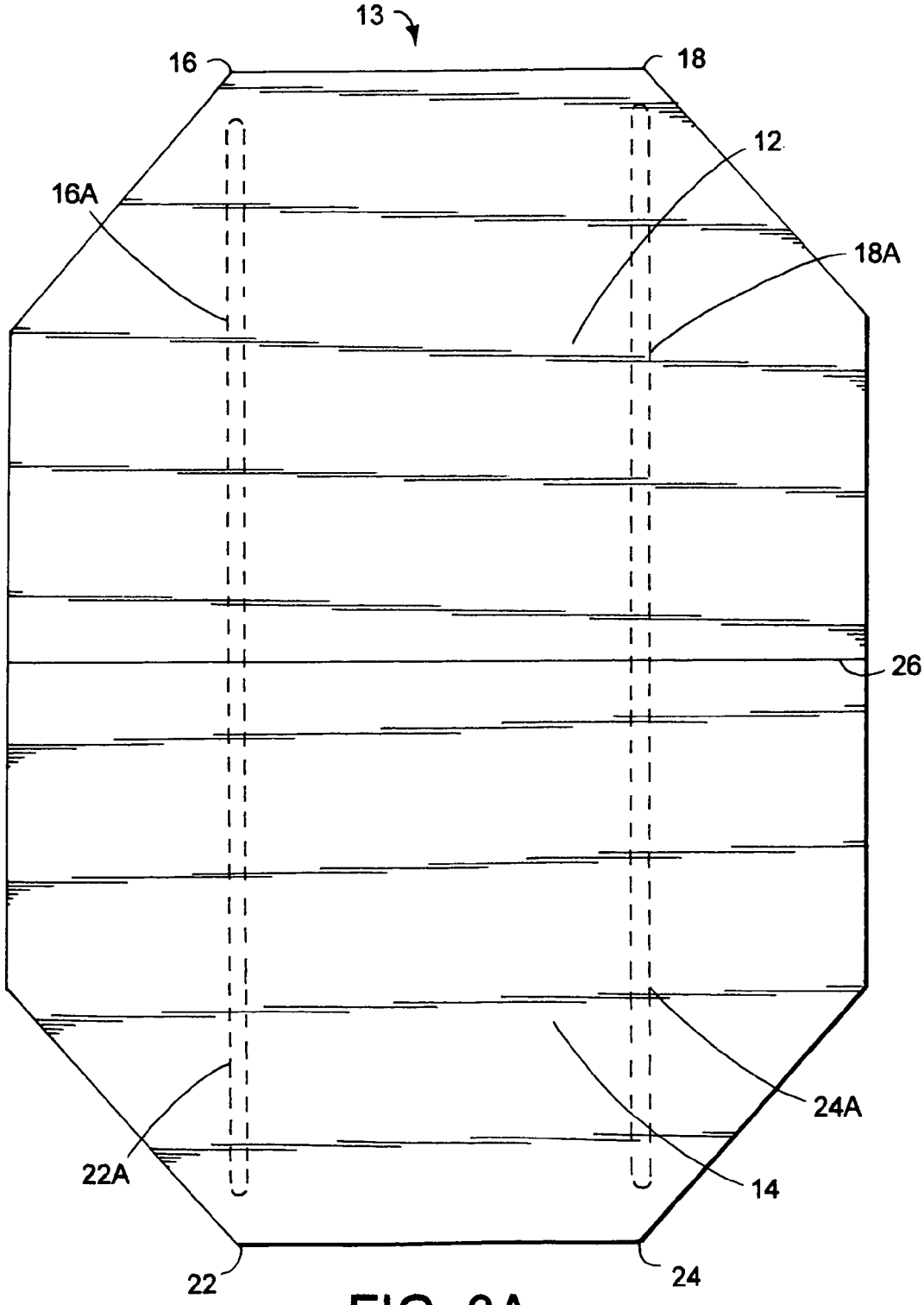
FIG. 3A is a plan view of a hinged or folding display panel for a "V"-shape folding bin.

FIG. 3A is a top view of a display panel assembly 13, comprising panels 12 and 14, for a "V" style art bin 20 comprising five pieces. The front and rear panels 12 and 14 support the art for viewing. The rear panel's top left 16 and top right 18 corners and the front panel top left 22 and top right 24 corners are cut at approximately 35 degree angles, giving the art bin panels a hexagonal or trapezoidal appearance. Both front 12 and rear 14 panels are joined horizontally at the bottom along line 26 to form a "V" shape by means of a pliable, interlocking, flexible material that can be used as a hinge, as described above. These two panels, which can vary in shape and size, support the art for viewing. These panels have horizontal lower edges 26, angled at the bottom of each panel as shown in FIG. 3E. On the backsides (outer or bottom sides) of each of the two panels are two female dovetail slots or grooves 16A, 18A, 22A and 24A that preferably start at the top left and top right of each 35 degree angle corner (16, 18, 22 and 24) and extend the length of the panel from top to bottom in a direction substantially perpendicular to line 26. The distance between the two female dovetail slots can vary according to the sizes of the front and rear panels and the desired positioning of the support brackets.

Figure 3B:
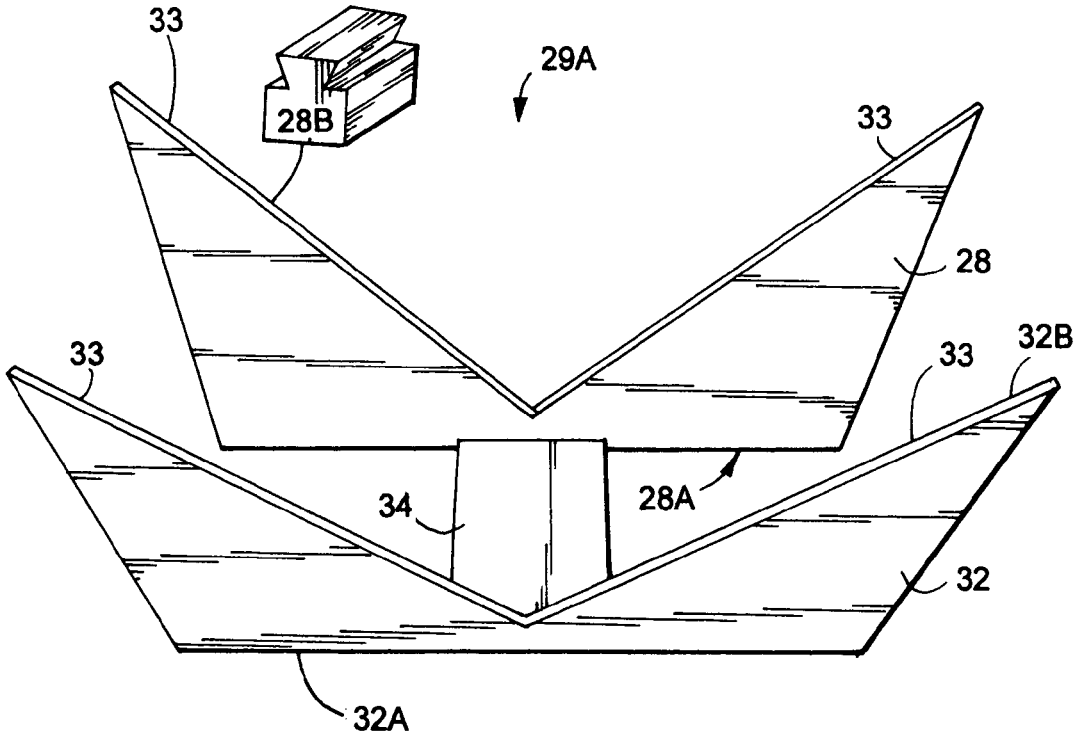
FIG. 3B is an end perspective view of assembled support brackets for supporting the display panel of FIG. 3A.

FIG. 3B illustrates an support bracket assembly 29A comprising two V-shaped support brackets (28 and 32), each of which are of one piece construction, resting upon lower edges 28A and 32A and angled at each end to support the display panels 12 and 14 at suitable acute angles from the horizontal. Brackets 28 and 32 are shown as connected at their bases by a rectangular support block 34 to position them in parallel orientation for supporting the display panels. Support block 34 can be three or more inches long and one or more inches high.

When viewing these support brackets from the side, the angled portions to the left and the right are separated and connected by a portion of the bracket or a gap.

The support bracket angled portions to the left and right incorporate a male dove tail finger 33 cut along the length of the upper edges 28B and 32B of the left and right portions of the support brackets 28 and 32.

The length, height and width of the left and right portions of the two support brackets may vary in size according to the dimensions of the display panels, the weight of the sheet goods to be displayed and other factors.

Similarly, the distance separating the two support brackets can be varied by selecting the length of support block 34, according to their sizes and the sizes of the panels.

Figure 3C:
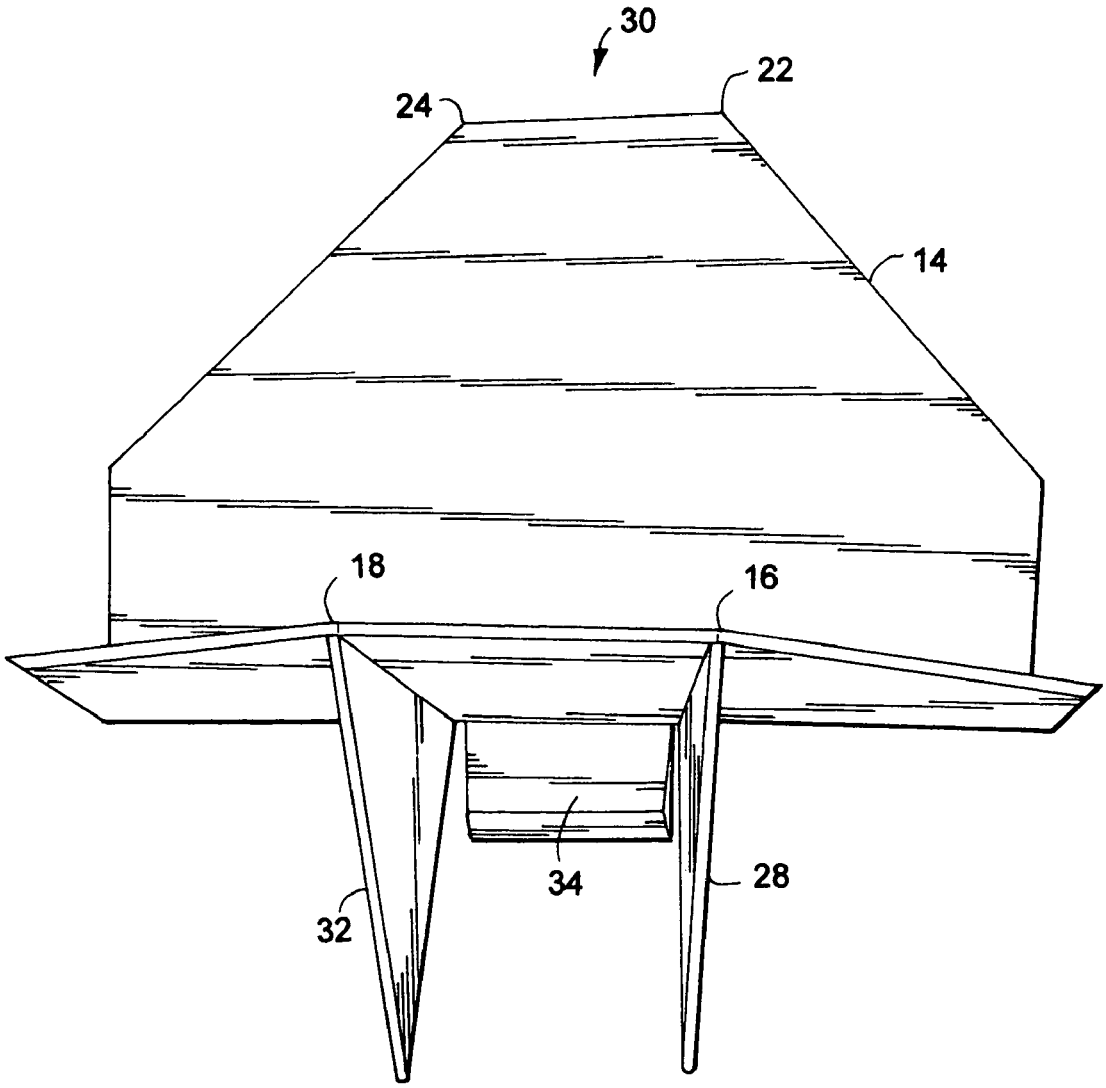
FIG. 3C is a side perspective view of a "V"-shape folding bin assembled for use by mounting the display panel of FIG. 3A on the supports of FIG. 3B.

FIG. 3C is a side perspective view of an assembled bin 30, with panel assembly 13 installed atop support bracket assembly 29, and showing support block 34 installed between support brackets 28 and 32. Support block 34 can be mounted using Velcro™ or other hook-and-loop fabric combinations between support brackets 28 and 32. It is normally the same distance as the panel 12's top left 16 and top right 18 corners and panel 14's top left 22 and top right 24 corners are spaced apart at the 35 degree angles in FIG. 3A.

Figure 3D:
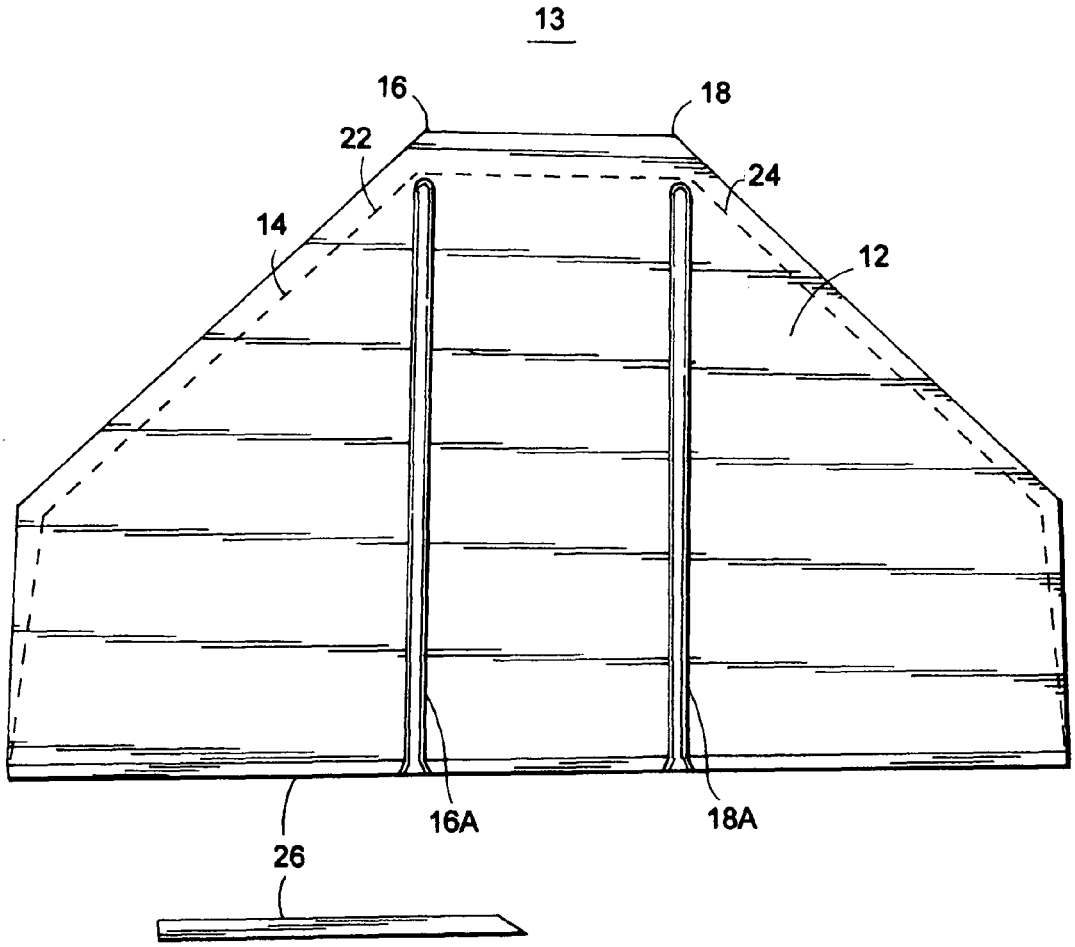
FIG. 3D is a side view of the bin of FIG. 3C.
Figure 3E:
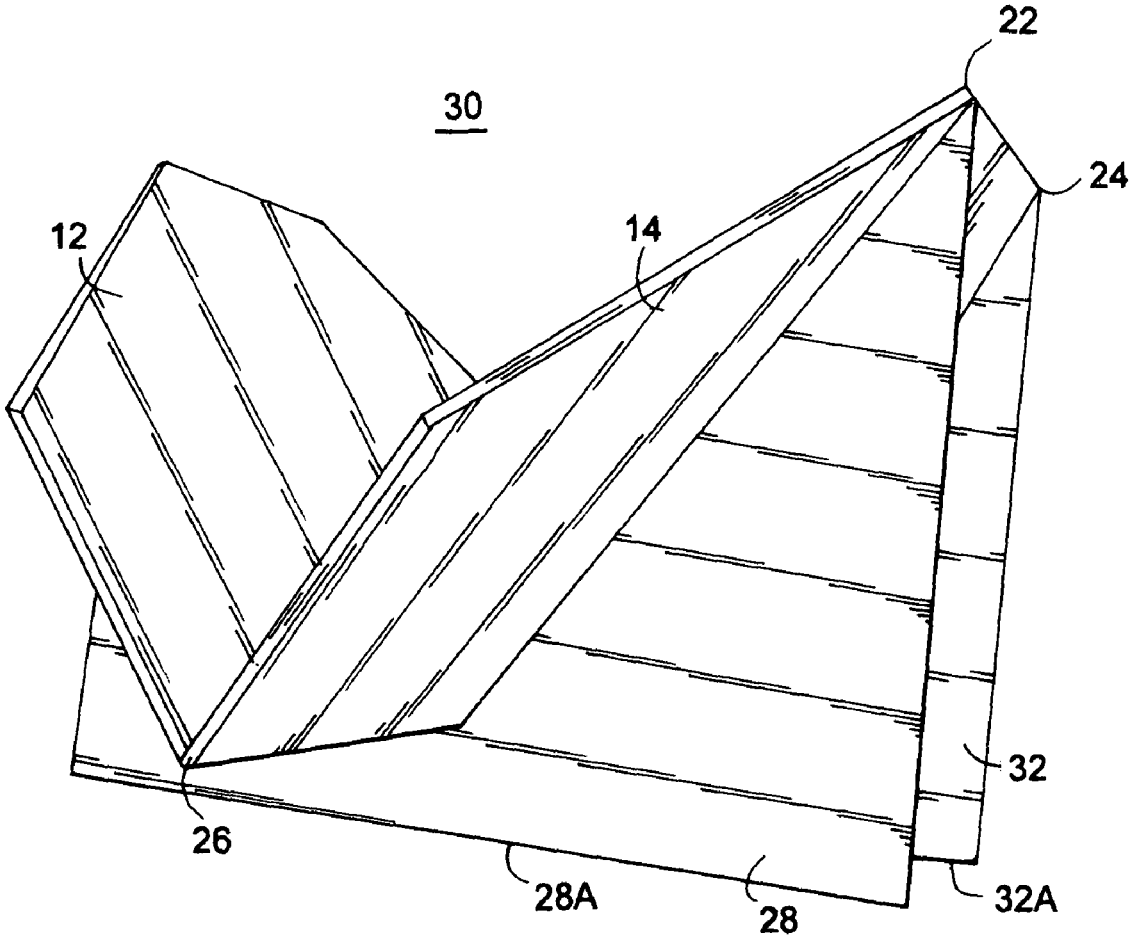
FIG. 3E is an end perspective view of the bin of FIG. 3C.

FIG. 3D is a side view of display panels 12 and 14 of panel assembly 13 collapsed or folded against each other for storage or transport. Dovetail grooves 16A and 18A are provided on the backsides or outer surfaces of the panels, as shown with panel 12 here, for attachment of the support brackets with their dovetail fingers on the vertical edges. The two display panels can vary in shape and size to support art or other sheet goods for viewing. Both panels 12 and 14 are chamfered at the bottom of each lower edge 26 to enable them to fit together at approximately the correct obtuse angle desired between them.

FIG. 3E is an end perspective view of the assembled five piece "V" shaped bin 30. To assemble the bin, the panels each slide down the lengths of the support bracket angled portions to the left and the right so that the male dove tail fingers 33 protruding along the lengths of the upper edges (28B and 32B) of the two support brackets engage the female dove tail grooves 16A and 18A (for panel 12), thus forming a stable combination of the support brackets and display panels and giving the assembled unit 30 the informal name "V" shape art bin.

This assembled five piece "V" shaped bin shows the attached panel 14 and support brackets 28 and 32 used to support panel 14. Similarly, the panel 12 components are attached to the other side of support brackets 28 (only partially visible in this view).

Figure 4A:
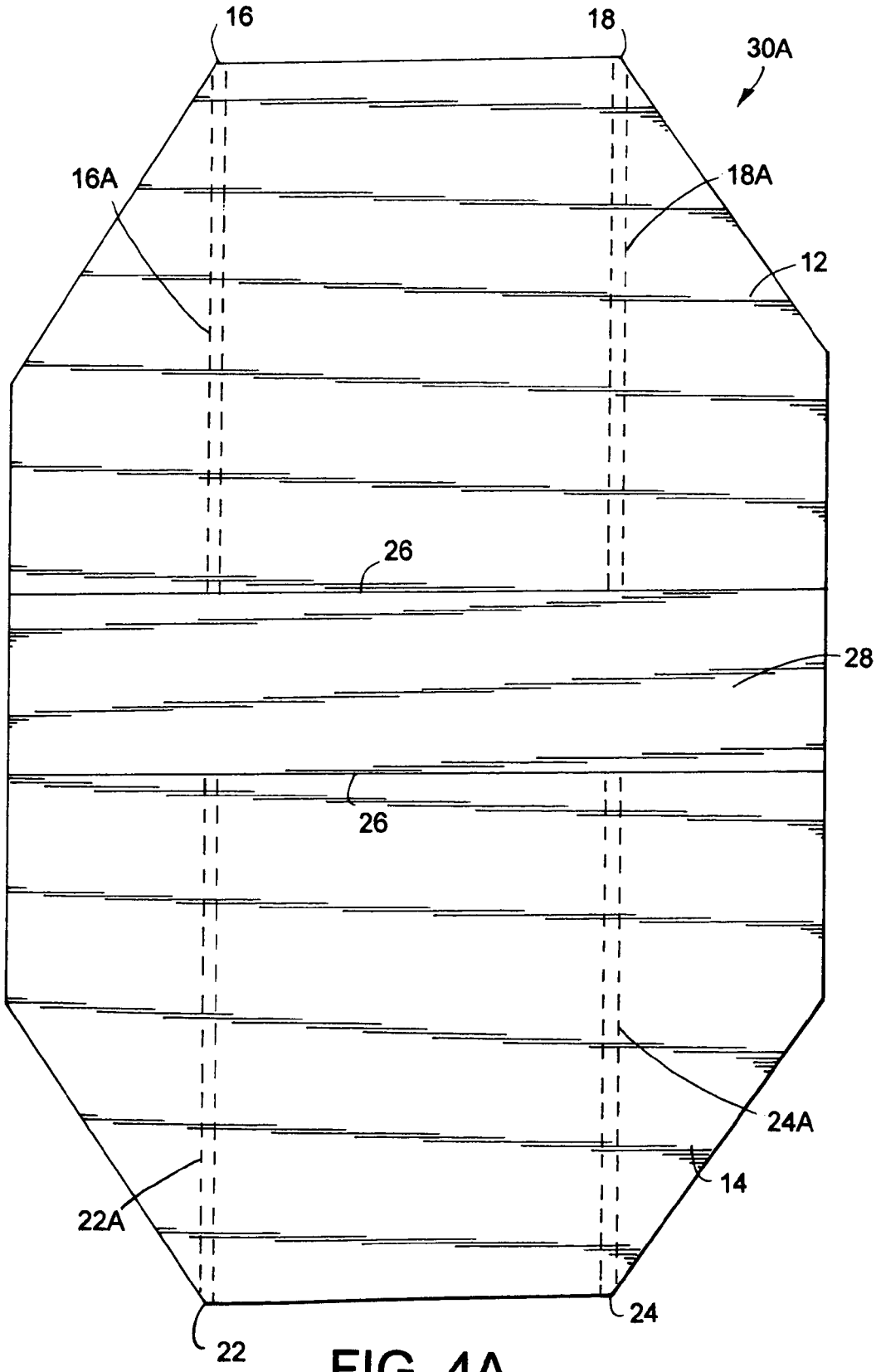
FIG. 4A is a plan view of the panels for a five-piece flat bottom folding bin.

FIG. 4A is a top view of an assembled one-piece collapsible "U" style art bin 30A comprising six pieces. The panels 12 and 14 support the art for viewing. The corners of both panels (16,18, 22 and 24) are cut at approximately 35 degree angles. Panels 12 and 14 are joined horizontally along lines 26 at the bottom to bottom panel 28 to form a substantially "U" or trough shape by means of a pliable, interlocking, flexible material that can be used as a hinge. These two panels can vary in shape and size to support the art for viewing. Panels 12 and 14 have lower edges 26, chamfered at the bottom of each panel to fit onto the edges of panel 28 to form suitable acute angles. On the backsides or outer surfaces of the two panels are two female dovetail slots or grooves (16A, 18A, 22A, 24A) that start at the top left and top right of each 35 degree angle cut (corners 16, 18, 22, 24) and travel the length of the panel from top to bottom, as discussed above for FIGS. 3A through 3E. The distance between the two female dovetail grooves varies according to the sizes of the panels and the separation of the support brackets.

Figure 4B:
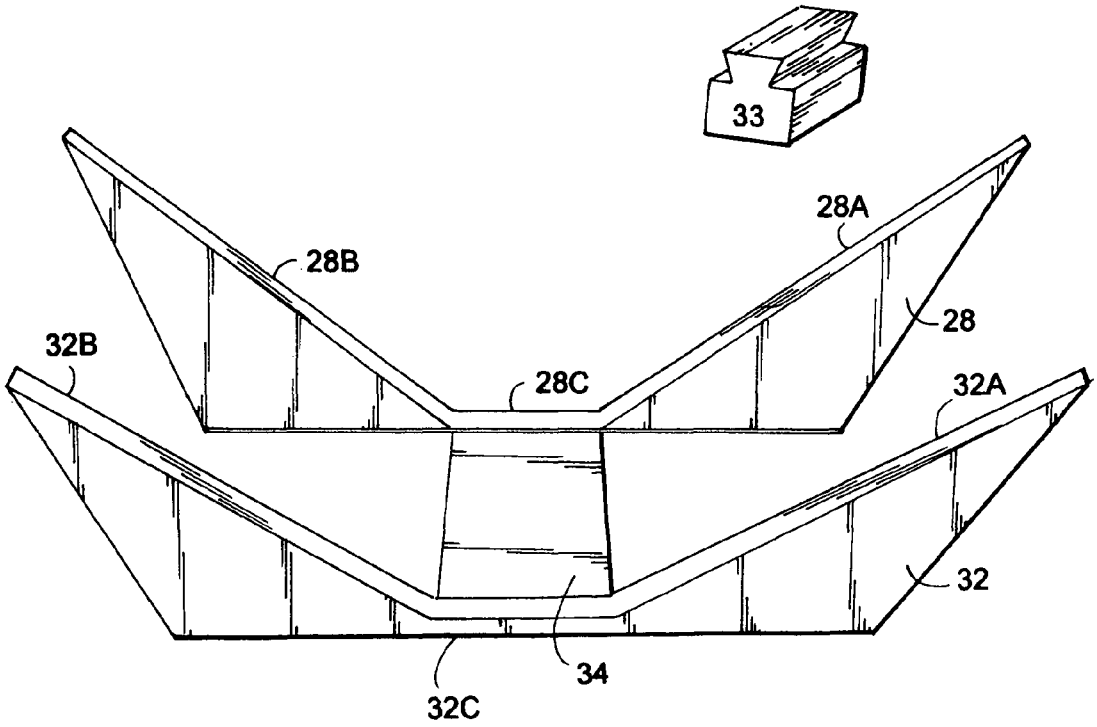
FIG. 4B is an end perspective view of support brackets and a base for the bin of FIG. 4A.

FIG. 4B shows an end perspective view of the two support brackets (28 and 32), which are each of a one-piece construction and angled at both ends to support the panels 12 and 14, with the angled portions separated by suitable gaps 28C and 32C to accommodate bottom panel 28 of the panel assembly (not shown in this view). Brackets 28 and 32 are joined at the bottom center (preferably by dovetail joints) by a substantially rectangular support block 34 that can be three or more inches wide and one or more inches high, depending on the size of the art bin.

When viewing these support brackets from a side view in FIG. 4B, the angled portions of the support brackets to the left and right incorporate male dove tail fingers 33 (shown in detail) cut along the lengths of their leading (upper) edges, e.g. 28A/28B and 32A/32B. The length, height and thickness of the two support brackets may vary according to various requirements. Similarly, the distances 28C and 32C separating the angled portions of the two support brackets can vary according to their size and the sizes of the two display panels and the bottom panel 28.

Support Block 34 is mounted between support brackets 28 and 32 and can be removed, providing male and female dove tail joints or other connecting means are provided.

Figure 4C:
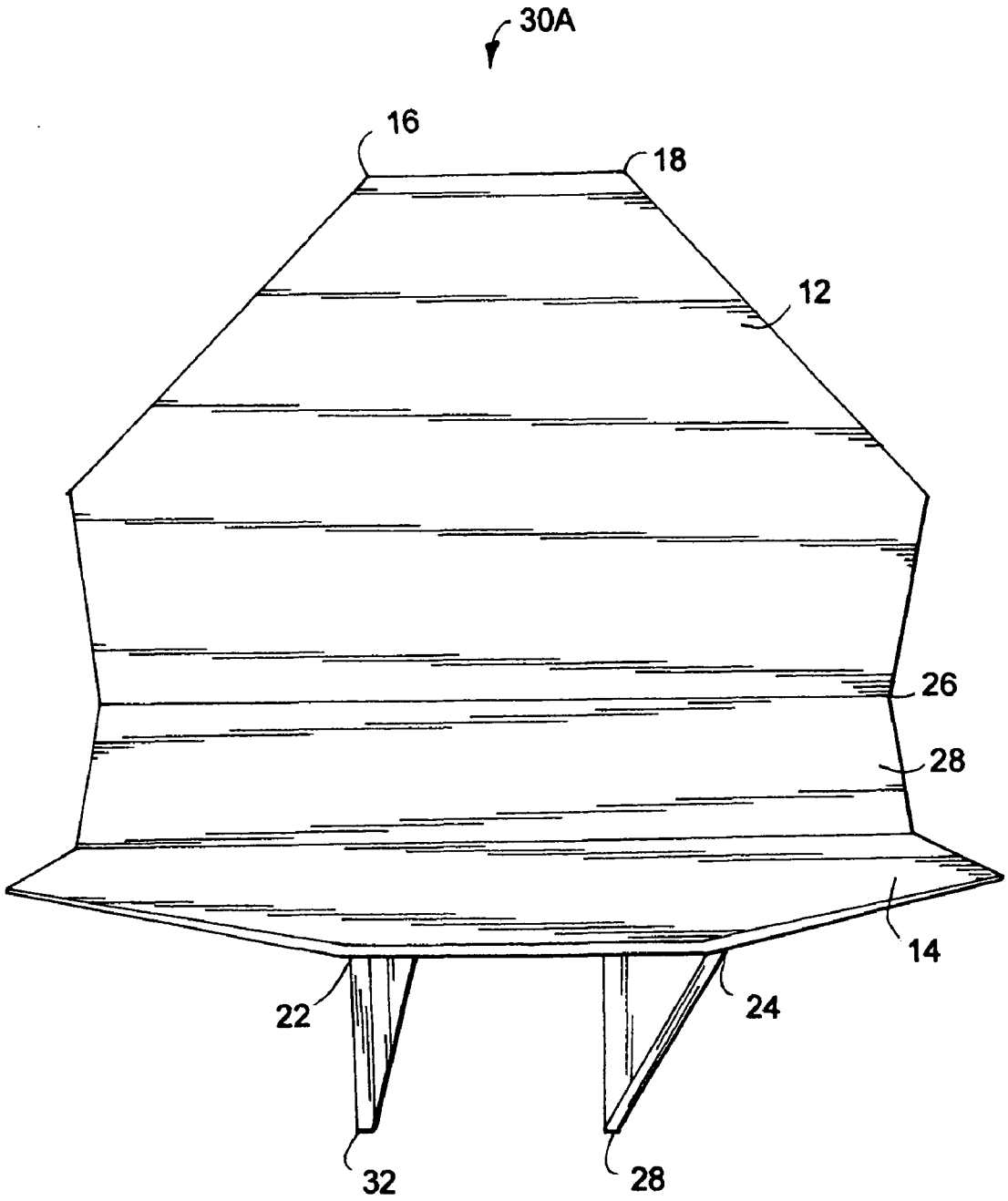
FIG. 4C is an overhead perspective view of an assembled bin of FIG. 4A.

FIG. 4C is an overhead perspective view of an assembled flat bottom "U" style art bin 30A. Bottom panel 28 is a substantially rectangular shape having two chamfered horizontal lower edges of about 45 degrees on both sides that extend the length of the panel. This panel faces upward and lies across the gaps 28C and 32C (See FIG. 4B.) in the two parallel support brackets which separate the two angled portions of the support brackets 28 and 32.

Figure 4D:
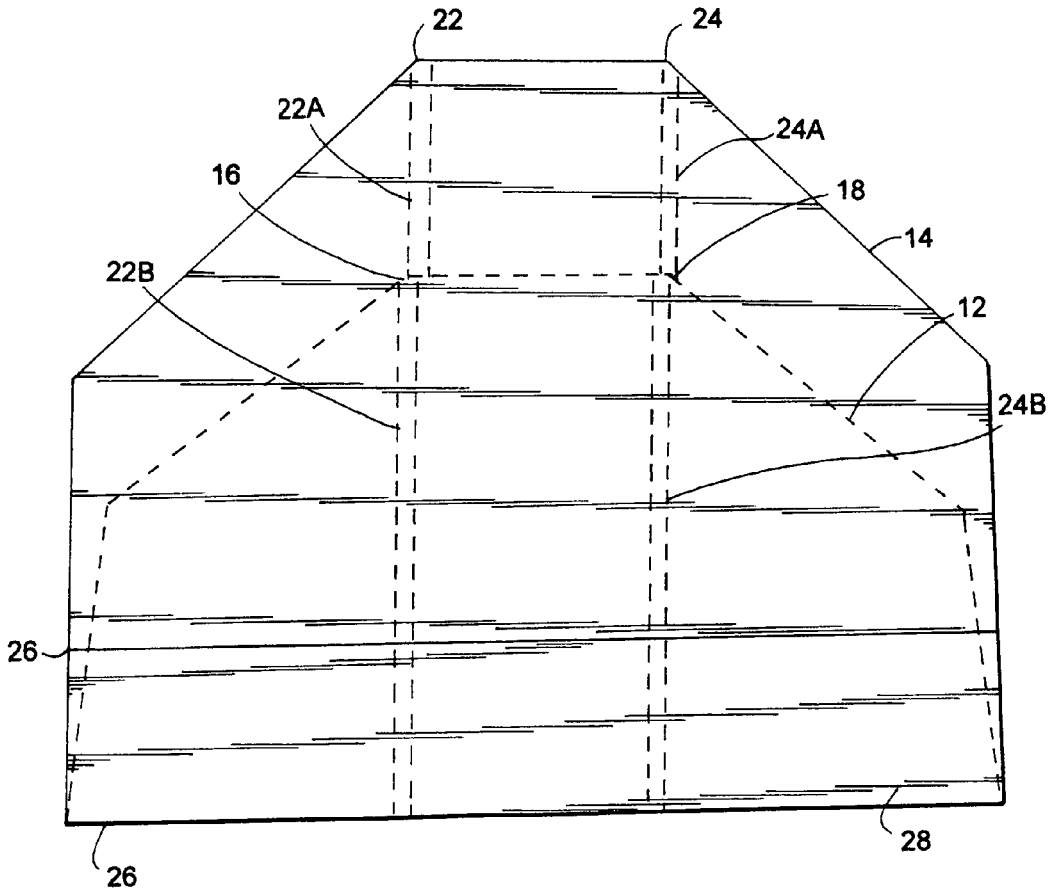
FIG. 4D is a side view of the panels of FIG. 4A folded upward.

FIG. 4D is a side view of the collapsed bottom panel 28 and panels 12 and 14, removed from the support brackets and producing a flat assembly for storage or shipment. Dovetail slots 22A and 24A in the outer surface of panel 14 are visible.

Figure 4E:
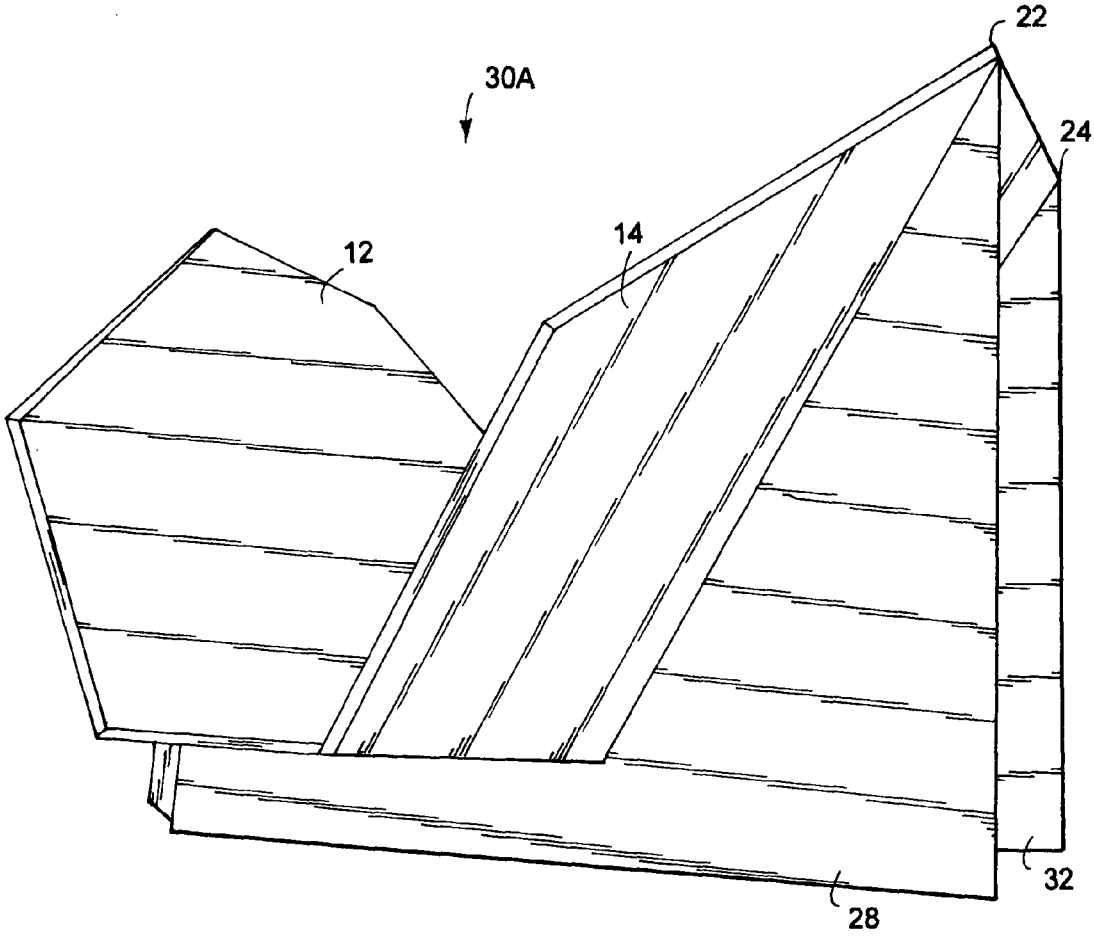
FIG. 4E is an end perspective view of the assembled bin of FIG. 4C.

FIG. 4E is an end perspective view of the flat bottom "U" shaped five piece art bin 30A of FIG. 4A.

To assemble the bin, panels 12 and 14 slide down the length of the upper edges of the two support brackets 28 and 32 so that the dove tail grooves in the panels 12 and 14 engage the male dove tail fingers 33 thereon, thus forming and giving the informal name "U" Shape Art Bin. The assembled five piece "U" art bin in FIG. 4E shows the attached panel 14 and support brackets 28 and 32 used to support the panel. The gap between the bases of the two panels (defined by the width of bottom base panel 28) can be varied in length to accommodate an unlimited amount of sheet art for viewing.

Figure 5A:
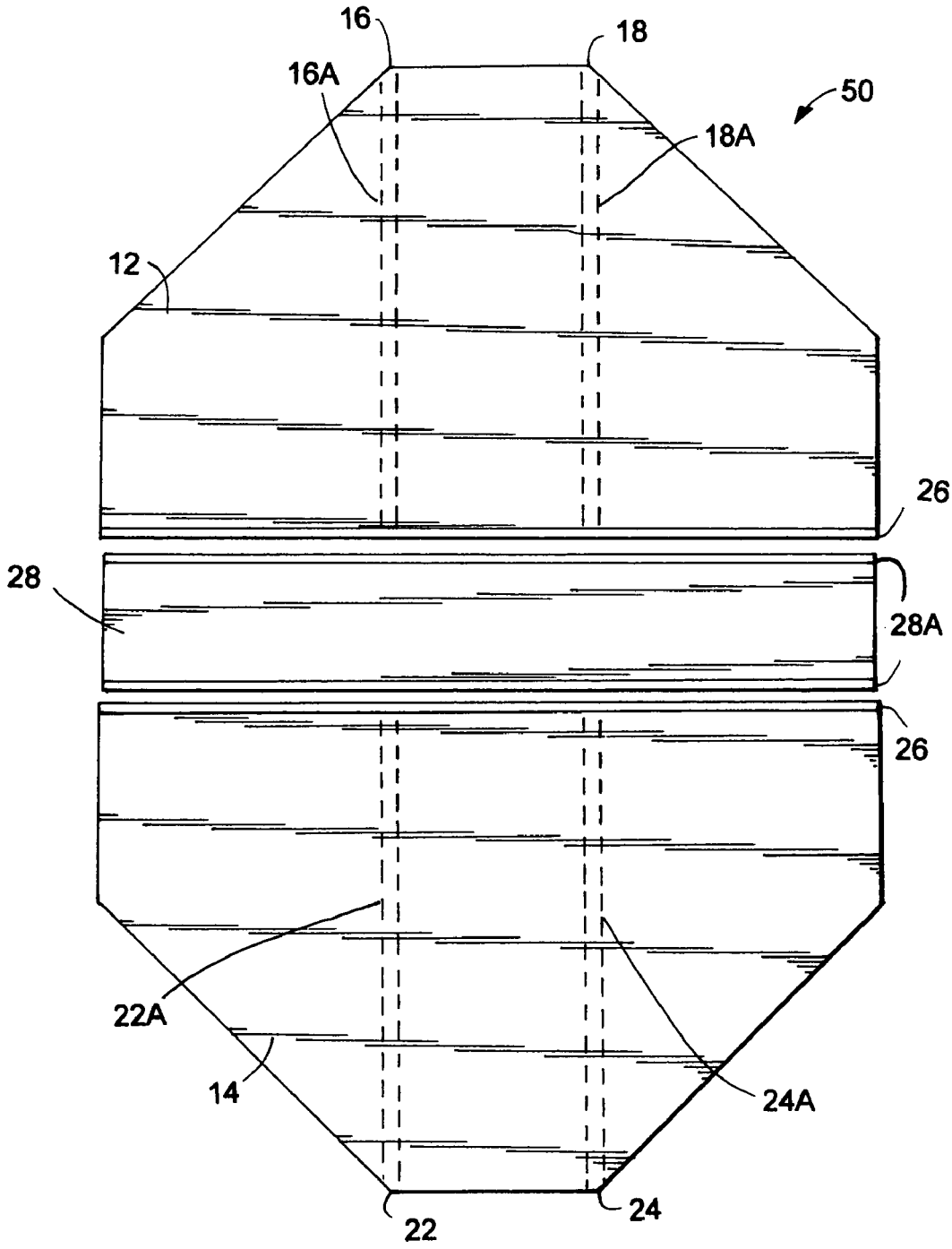
FIG. 5A is a plan view of two panels laid out adjacent a base for a flat bottom bin featuring dovetail joints.

FIG. 5A is a top view of panel components for a collapsible "U" style art bin 50 comprising five pieces. The trapezoidal panels 12 and 14 support the art for viewing. The panels' top corners (16,18,22 and 24) are cut at 35 degree angles, forming panels which are substantially trapezoidal in form. These two panels can vary in shape and size as required by the art to be displayed for viewing. Bottom edges 26 of panels 12 and 14 are chamfered on their upper sides at acute angles suitable to mate with the chamfered edges 28A of bottom panel 28. Bottom base panel 28 is a substantially rectangular sheet having two chamfered horizontal edges 28A of suitable angles on both sides to mate with the lower panel edges, which extend the length of the panel. Panel 28 faces upward and lies perpendicular across the portions of the two parallel support brackets 28 and 32 (shown in FIG. 5B) separated by gaps 28C and 32C between the two dovetailed leading edges of the angled portions of brackets 28 and 32.

On the backsides or outer surfaces of each of the two panels 12 and 14, as shown in FIG. 5A, are two female dovetail slots (16A, 18A, 22A, 24A) which start at the top left and top right of each panel corner and extend the length of the panel from top to bottom in a direction substantially perpendicular to the bottom edges 26 of the panels. The distances between the two pairs of dovetail slots can vary according to the sizes of the panels.

Figure 5B:
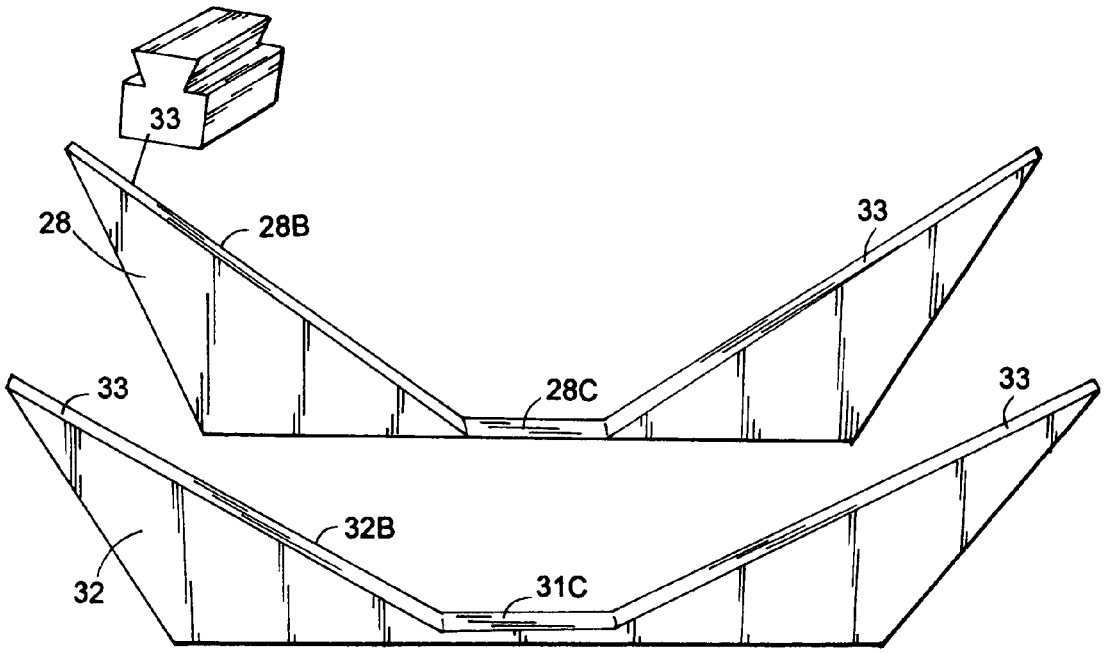
FIG. 5B is a perspective view of two support brackets for the bin, with a detail view of a dovetail finger along the outer edge.

FIG. 5B is an end perspective view showing the two support brackets (28 and 32), each having a one-piece construction, with portions angled at both ends at a suitable acute angle from the horizontal to support the panels 12 and 14 at suitable angles for display of the art or other sheet goods to be displayed. These acute angles can be the same or different, depending upon the requirements for a particular bin design.

When viewing these support brackets from the side, the angled portions to the right and left are separated by connecting gaps 28C and 32C which can be any suitable dimensions, e.g., about three or more inches long and about one or more inches high, depending on the size of the art bin.

The angled outer edges 28B and 32B of support brackets 28 and 32 on the left and right angled portions incorporate male dovetail fingers 33 cut along the lengths of these edges. The length, height and width of the two support brackets may vary in size as required by the overall dimensions of the bin and the display panels.

Figure 5C:
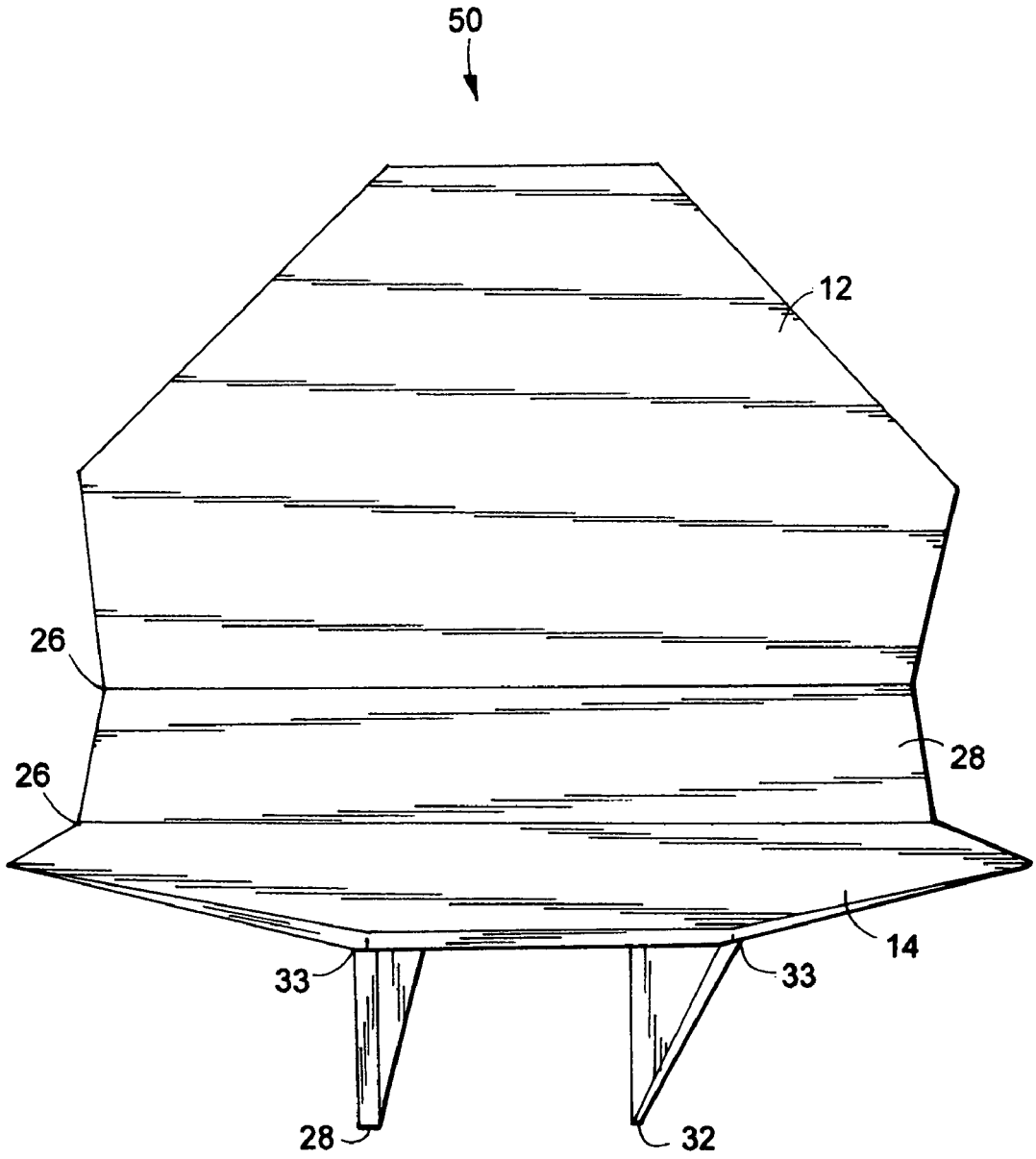
FIG. 5C is a top perspective view of an assembled bin with support brackets attached by dovetail joints.

FIG. 5C is an overhead perspective view of a flat bottom "U" style art bin 50 assembled from the components of FIGS. 5A and 5B. The bottom panel 28 has a substantially rectangular shape having two chamfered horizontal leading edges 26 of suitable angles on both sides that extend the length of the panel. This panel faces upward and lies across the two vertical support brackets 28 and 32, separated by gaps 28C and 32C between the two male dovetailed upper edges of the angled portions of the support brackets.

Figure 5D:
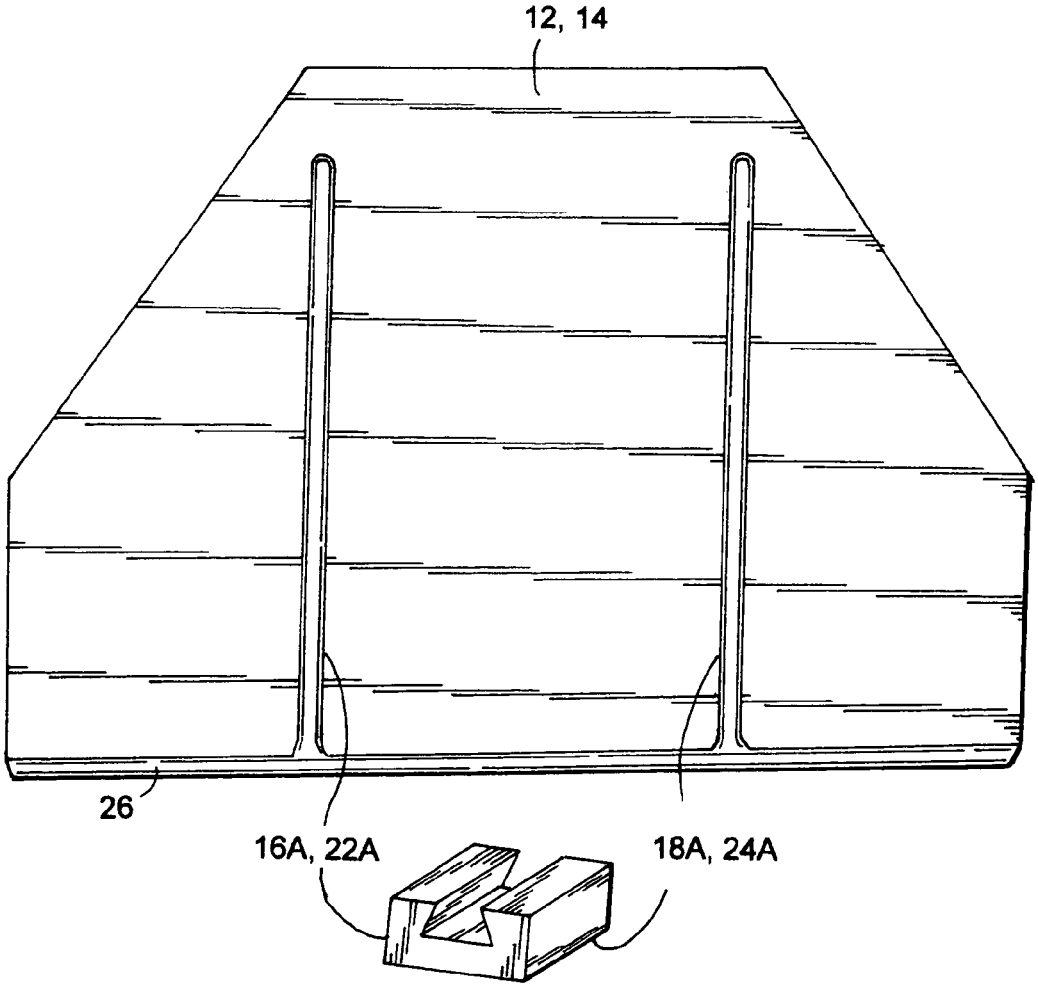
FIG. 5D is an elevation view of a display panel for the assembled bin of FIG. 5A

FIG. 5D is an elevation view of the display panel 12, showing the female dove tail slots 16 and 18, shown in sectional detail. In assembling this embodiment, the display panels 12 and 14 slide down the length of the edges of the angled portions of support brackets 28 and 32 to the left and the right, engaging the male dovetail fingers 33 protruding along the length of the leading edges of the two support brackets, thus forming and giving the informal name "U" shape art bin. The assembled five piece "U" shaped art bin of FIG. 5C shows the attached [Rear] panel 14 and left [Rear] support bracket 28 and [Right Rear] support bracket 32 used to support the display panels (14 and 12). The one-piece construction of the two vertical support brackets separated by a central gap between the angled portions of the two support brackets can vary in length and gap sizes to accommodate an essentially unlimited quantity of sheet goods such as art for viewing.

Figure 6A:
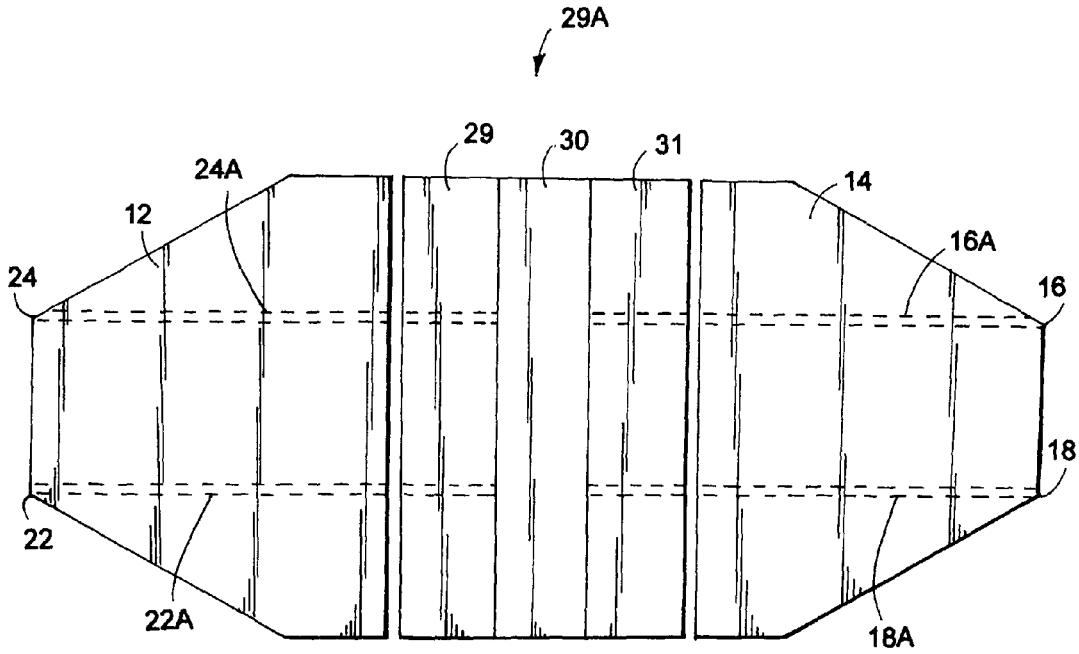
FIG. 6A is a plan view of two display panels arranged adjacent a three piece base support for a flat bottom collapsible bin.

FIG. 6A is a top view of a modified embodiment 60 of the collapsible "U" style art bins of Figures series 4 and 5. The trapezoidal panels front (12) and rear (14) support the art for viewing as in the embodiments discussed above. Dovetail grooves 16A through 24A on the outer edges of the panels are shown in dotted lines.

Figure 6B:
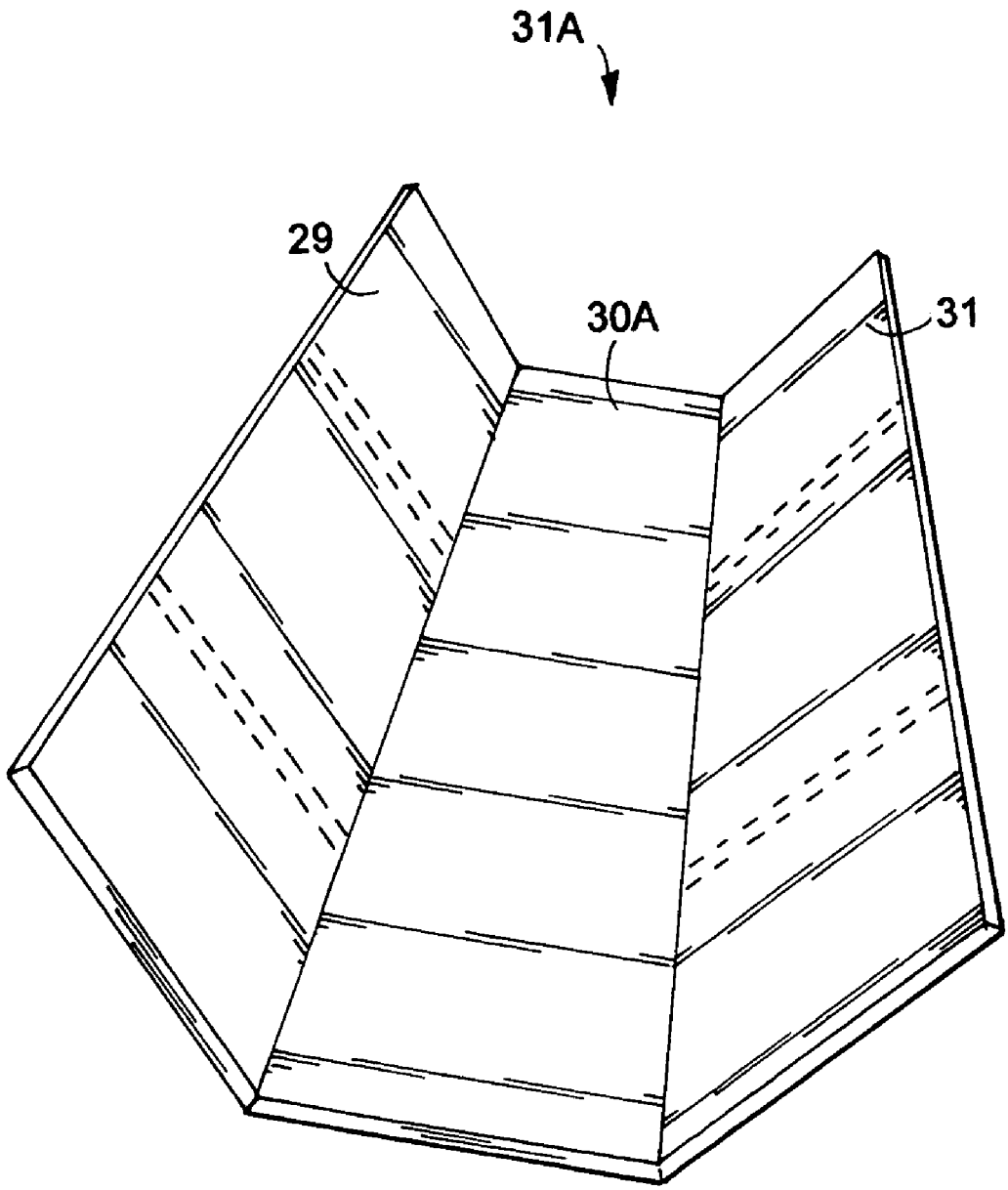
FIG. 6B is an end perspective view of the flat bottom or U-shaped base support for the bin of FIG. 6A.

FIG. 6B is an end perspective view of the principal feature of this embodiment. Bottom base support 28A is a one piece rectangular trough-shaped base comprising three rectangular sections (29, 30A, and 31) joined together as one piece. Sections 29 and 31 are chamfered at their bottom edges and joined to base section 30A (whose edges are also chamfered) to form a one-piece unit with a trapezoidal cross section and suitable acute angles from the horizontal for sections 29 and 31, which will be joined to panels 12 and 14 as shown in FIG. 6A. Depending on the material used, a one piece "U" shaped unit of this type may be needed to stabilize the base of the art bin. The two "edge support" sections 29 and 31 can form a continuation of the front and rear panels 12 and 14. Although this base unit does not fold flat, it can have dimensions which permit the complete art bin to be disassembled and packed compactly into a rectangular container which can be carried or shipped conveniently. The outer surfaces of sections 29 and 31 also have female dove tail slots for assembly of the unit by mating with dove tail fingers of the support brackets.

Figure 6C:
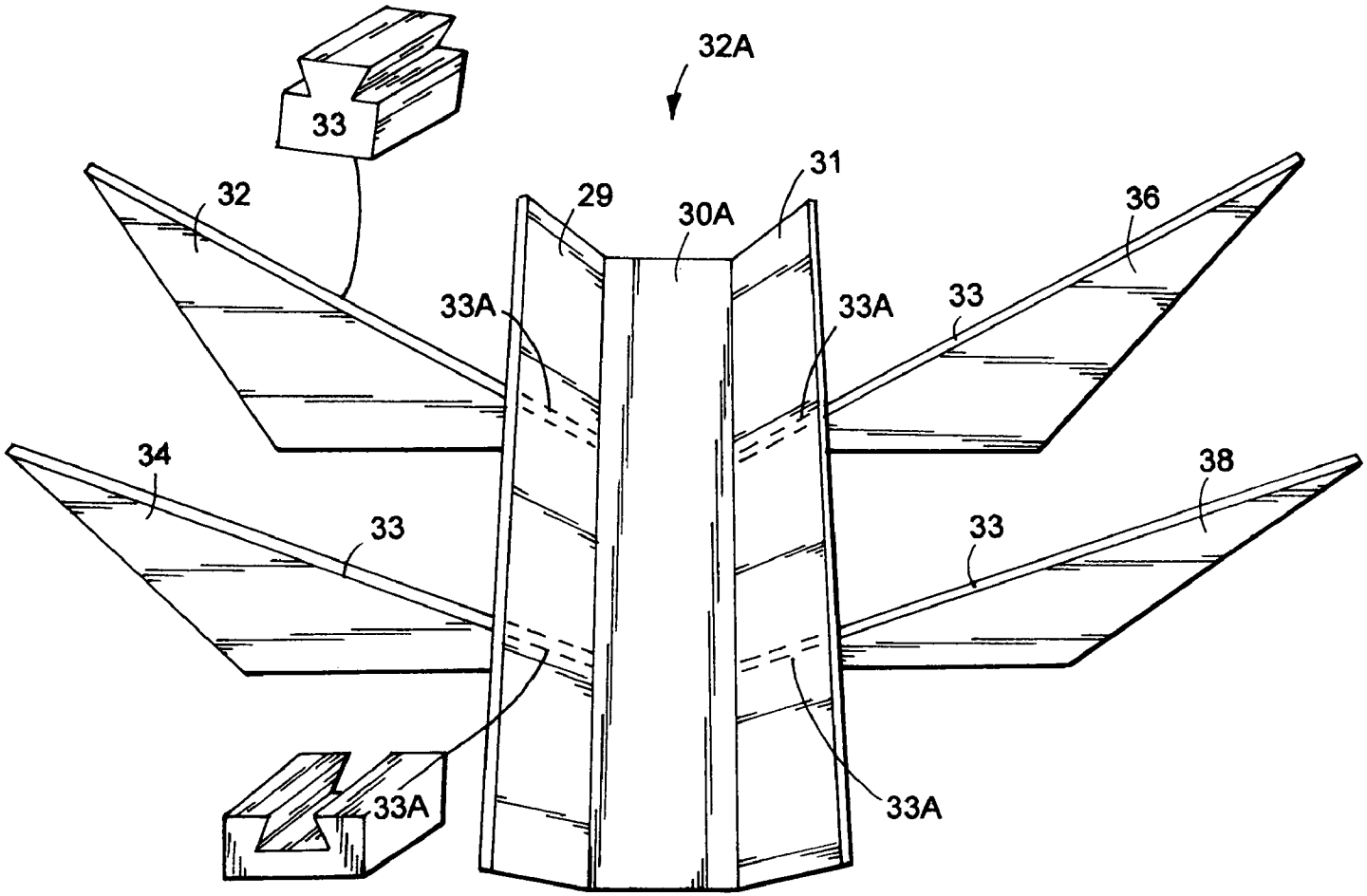
FIG. 6C is an overhead perspective view showing the placement of support brackets on the outer surfaces of the fixed angled supports of the base support for the bin of FIG. 6A.

FIG. 6C is a top perspective view of a partially assembled art bin 32A. Two sets of independent support brackets (32, 34 and 36, 38) with dovetail fingers 33 along their leading (upper) edges are used to support front panel 12, rear panel 14 and join them to edge support sections 29 and 31 by mating the dovetail tongues 33 of the brackets with the female 33A dovetail grooves of both the panels and edge support sections to form secure dovetail joints. These support brackets, when installed and viewed from the side, form suitable acute angles from the horizontal (and base panel 30A) to support the display panels at suitable angles for display of sheet goods. When thus installed, the support brackets at left and right are separated by the trough-like base formed by the three bottom panels (29, 30A, and 31).

Figure 6D:
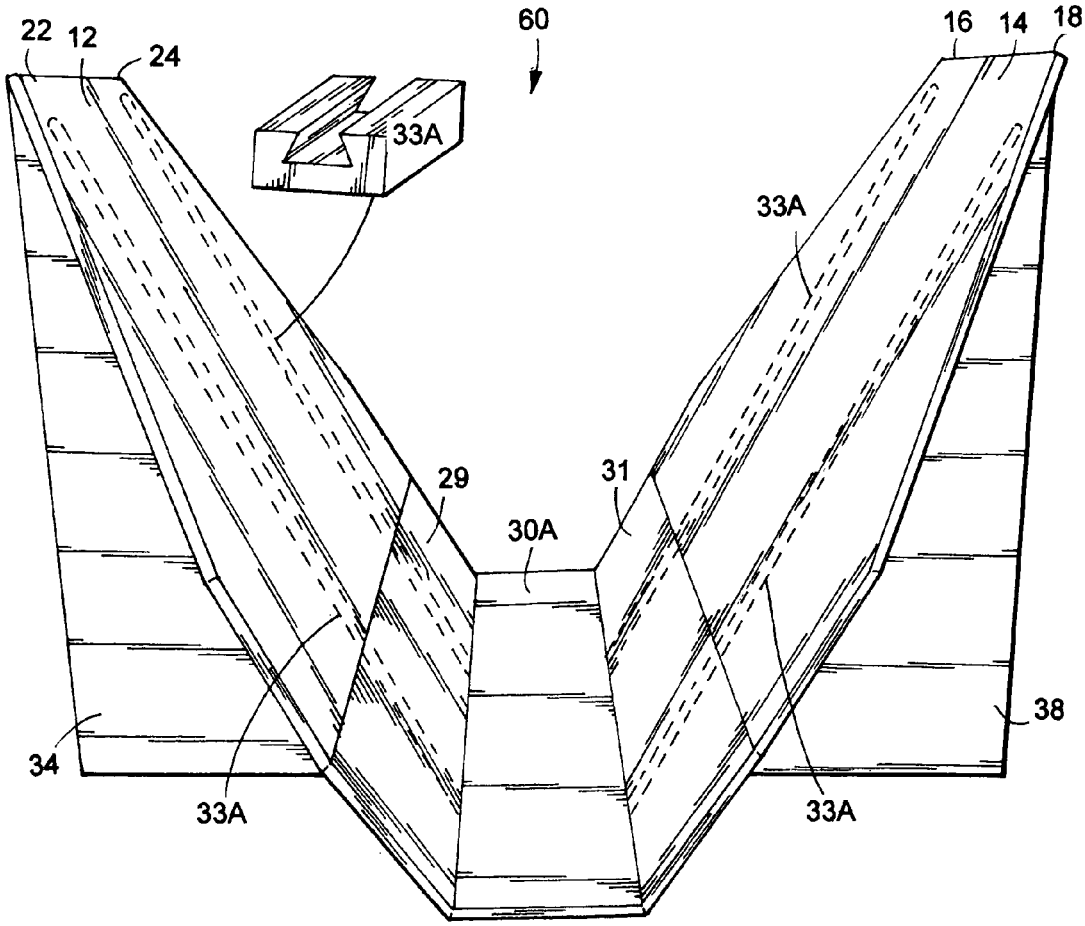
FIG. 6D is an end perspective view of an assembled bin comprising the components of FIGS. 6A, 6B and 6C.

FIG. 6D is a side perspective view of an assembled art bin unit 60. The two panels 12 and 14 support the art and are supported by the support brackets (34 and 38 in foreground) just above panels 29 and 31. On the backsides of each of the two panels (as in previous embodiments) are two female dove tail slots 33A that start at the top left and top right of each 45 degree angle (22, 24 and 16, 18) and travel the length of the panel from top to bottom and stop near the predetermined point at the top shown here in dotted lines. The distances between the two female dovetail slots can vary according to the sizes of the front and rear panels. The two panels 12 and 14 now rest on top of bottom panels 29 and 31. The four support brackets (34 and 38 visible) have been slid into place so that the male dove tail fingers 33, FIG. 6C on their leading or upper edges mate with the dove tail grooves in both the display and base panels to form a secure assembled unit.

Figure 6E:
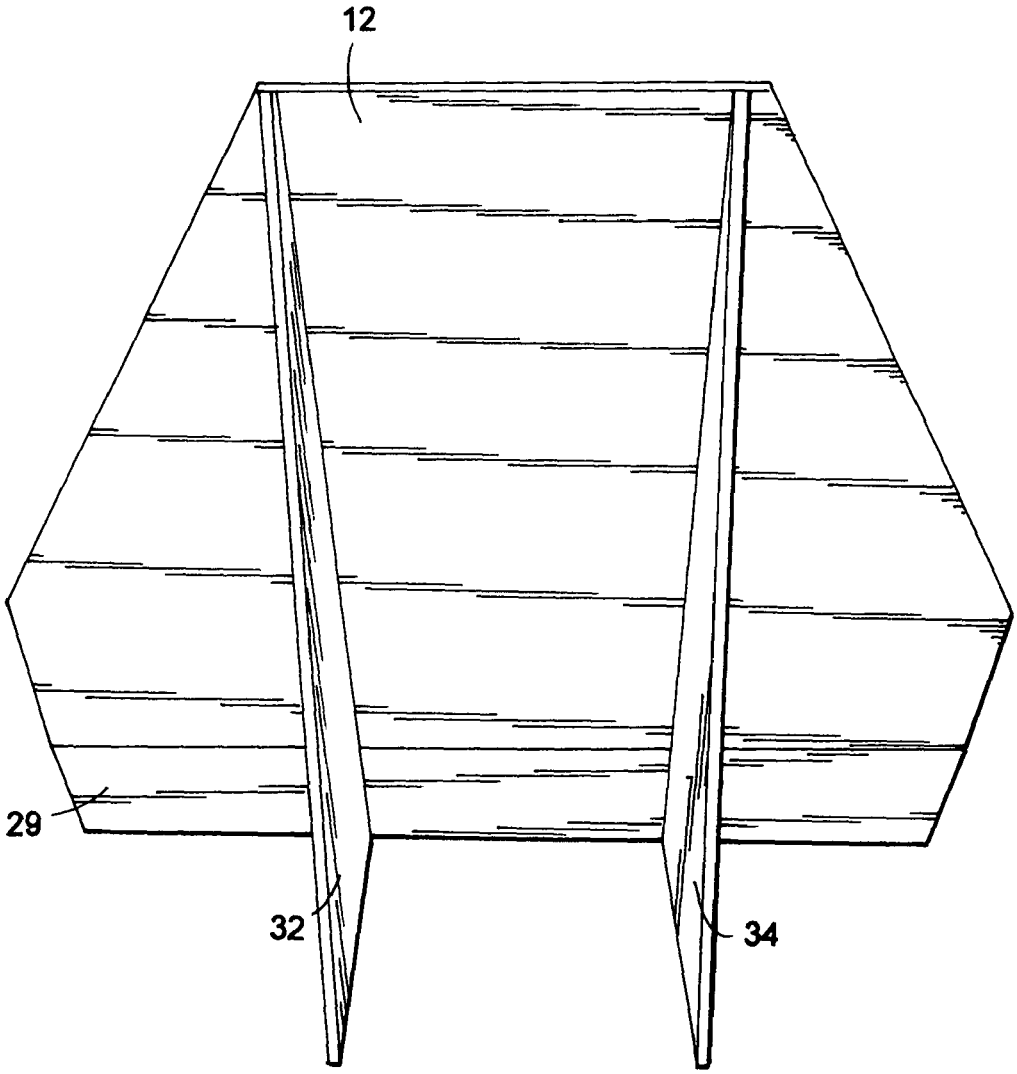
FIG. 6E is a side view of the assembled bin of FIG. 6D.

FIG. 6E is a rear view of the assembled unit 60 showing how the dove tail fingers of the support brackets 32 and 34 have been mated with the dove tail slots in the backs of both panels 12 and 29 to form a stable structure.

Figure 7A:
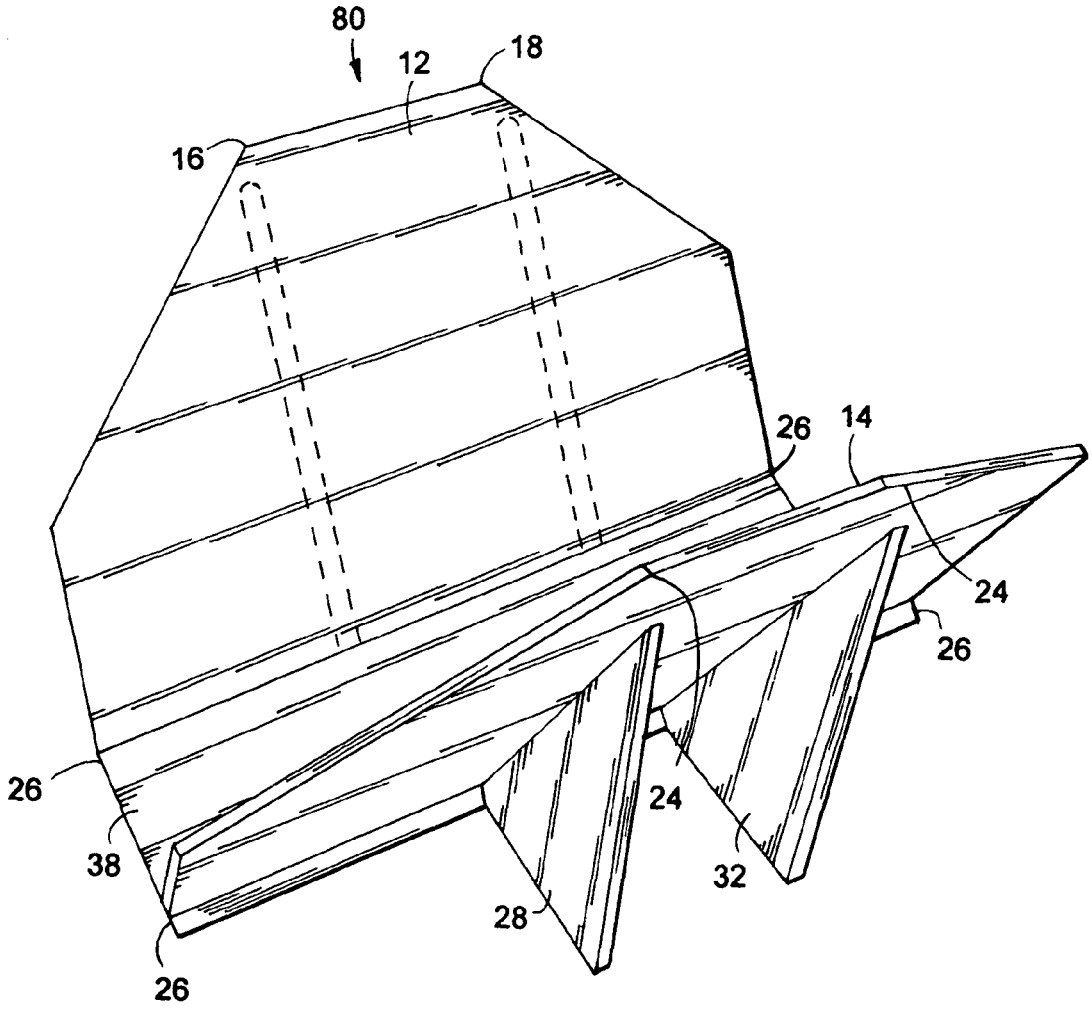
FIG. 7A is an overhead perspective view of an assembled U-bottom bin.
Figure 7B:
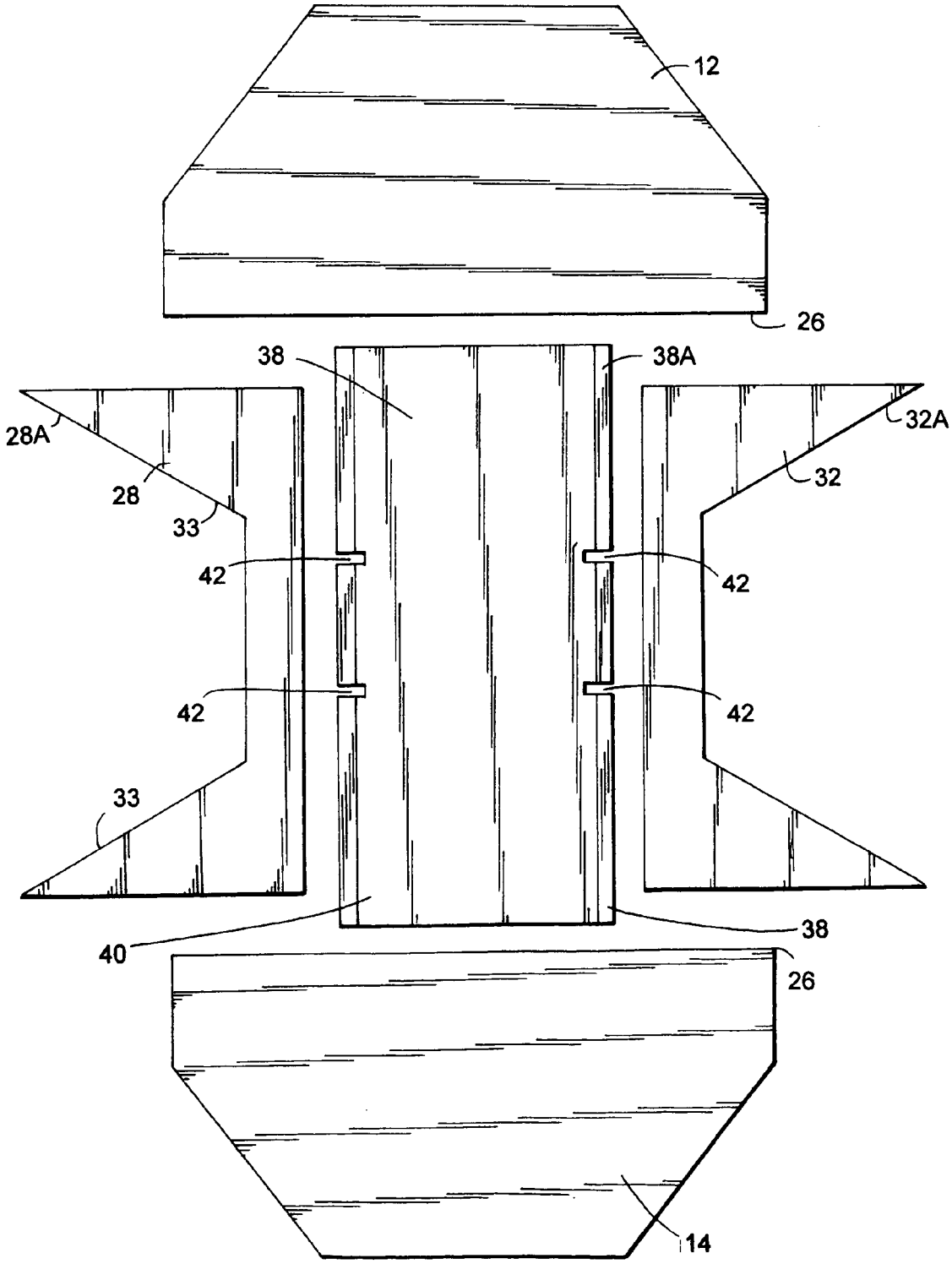
FIG. 7B is a plan view of the components of the bin of FIG. 7A disassembled and laid flat.
Figure 7C:
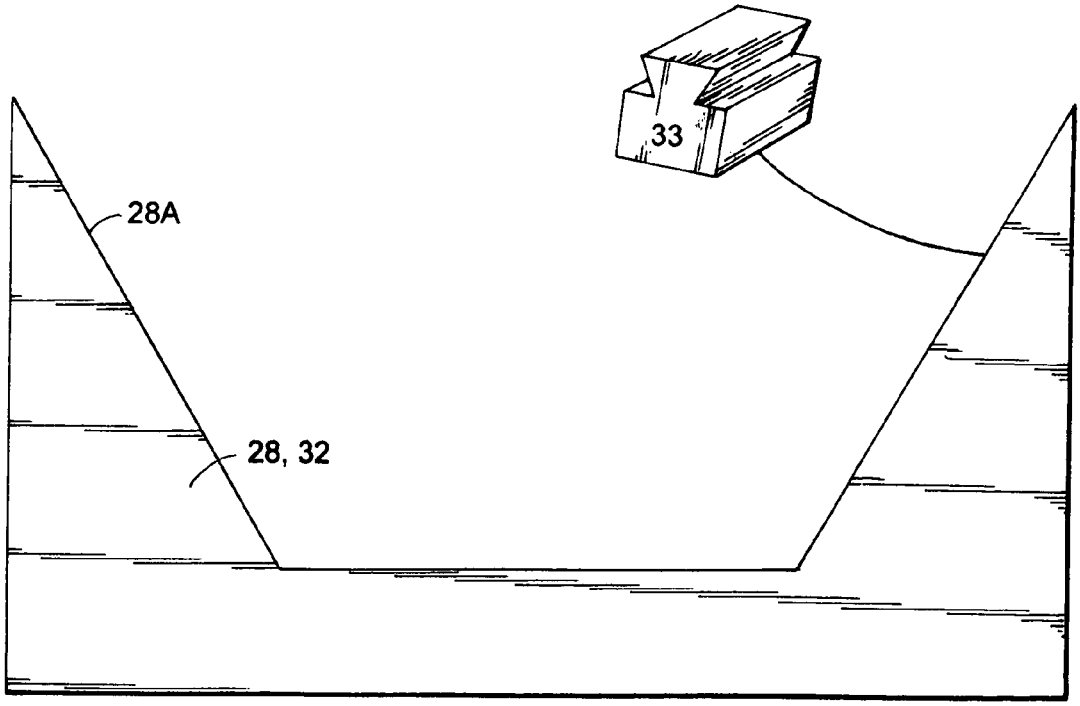
FIG. 7C is a side view of a U-shaped support bracket for the bin of FIG. 7A.
Figure 7D:
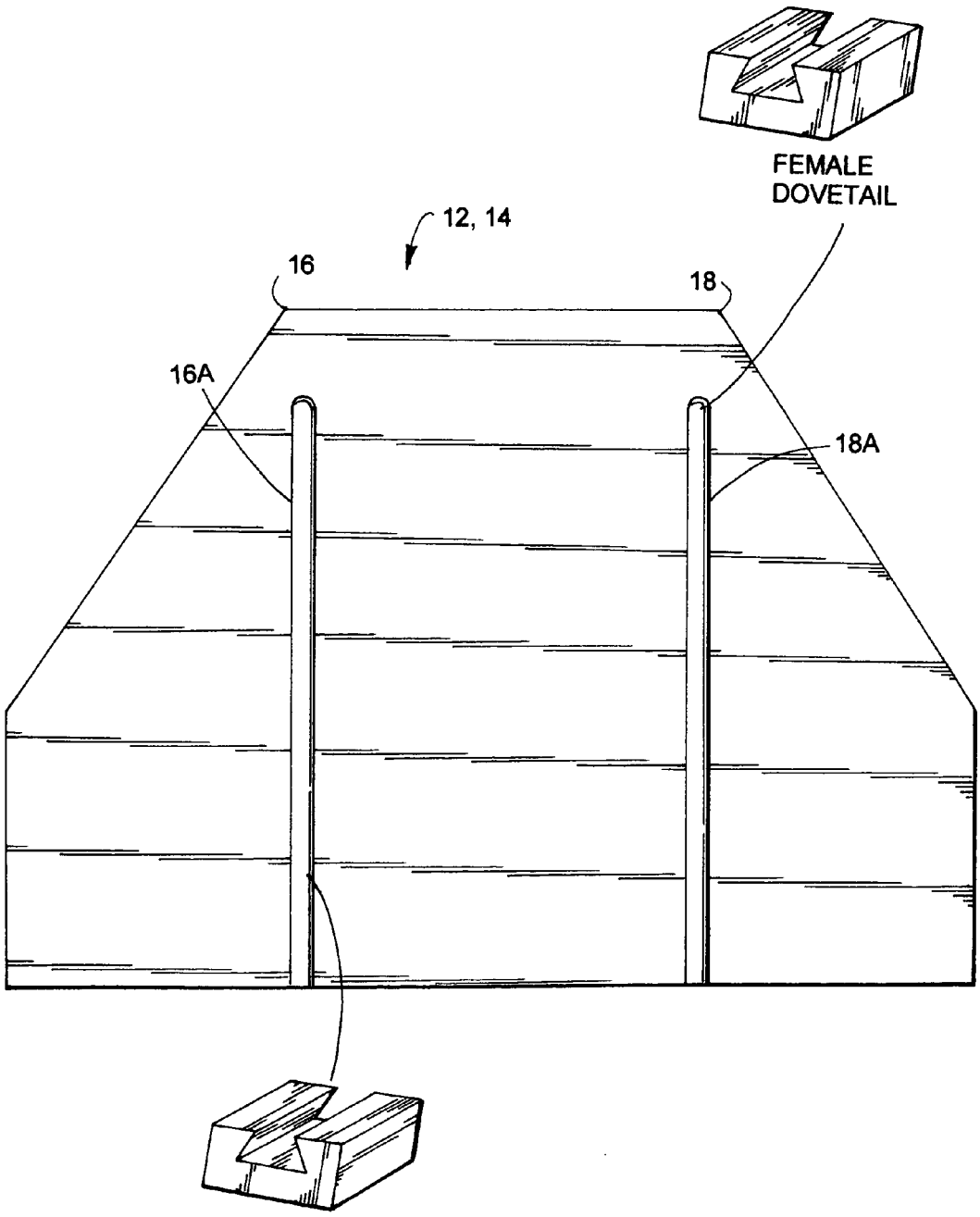
FIG. 7D is a side view of a display panel for the bin of FIG. 7A.

FIG. 7A is a top perspective view of a "HEX" style back support bin 80 made up of five pieces. The trapezoidal panels front (12) and rear (14) support the art for viewing. The corners of both panels are cut at the top left (16) top right (18) of the "front" panel 12 and the top left (22) top right (24) of the "rear" panel 14 at approximately 35 degree angles, thus giving the art bin the informal name "HEX". As shown in FIG. 7D, two female dove tail slots 16A and 18A align with the top left and top right corners 16 and 18 of panels 12 and 14 and extend the vertical length of the panel starting at the bottom and stopping at a predetermined distance from the top. The two vertical female dove tail slots are positioned to mate with male dove tail fingers 33 on the leading (angled upper) edges 28A of the one-piece support brackets 28 and 32 shown in FIG. 7C. The distances between the two female dove tail slots can vary according to the size and shape of the panels.

The two panels 12 and 14 are supported and separated at their bottom edges 26 by a bottom panel 38 which has chamfered edges 30A along the sides supporting the panels. The bottom panel 38 also has four horizontal slots 42, seen in FIGS. 7B and 7E, that mate with the upper edges of the angled portions of support brackets 28 and 32 in assembling the unit. FIG. 7B is an overall top view of the disassembled five pieces that make up the art bin. The unit can be easily assembled from these components, and just as easily disassembled and arranged into a flat package for shipment or storage. The display panels 12 and 14 support the art for viewing. On the backside of each panel are two female dove tail slots, shown in detail in FIG. 7D. Support brackets 28 and 32 each have male dove tail FIG. 33 located on each of their four upper edges 28A and 32A, particularly in FIG. 7C.

Figure 7E:
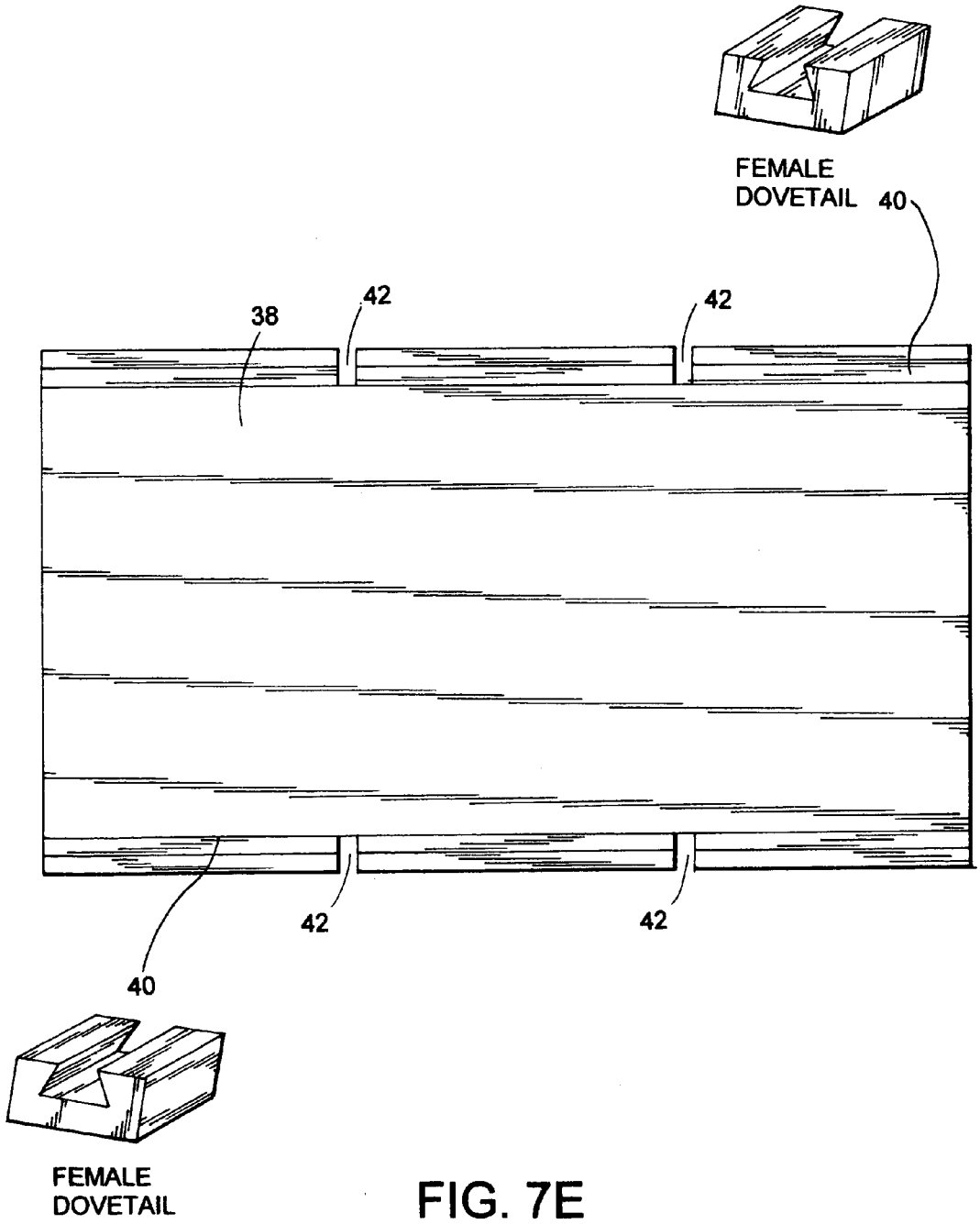
FIG. 7E is a plan view of a base panel for the bin of FIG. 7A, showing dovetail grooves parallel to the edges thereof.

Bottom base panel 38 is shown and described in detail in FIG. 7E. FIG. 7C is a side view of one of the two support brackets 28 and 32, which are of one-piece construction and have portions angled at both ends at suitable angles from the horizontal to support the panels 12 and 14.

The angled portions of the brackets to the left and right are separated by a gap 28B designed to accommodate and support a bottom panel (38) that is three or more inches wide and one or more inches high, depending on the size of the art bin. The angled portions to left and right incorporate male dove tail fingers 33 cut along the lengths of their upper angled edges 28A and 32A. The distance separating the angled portions to the left and right can be varied according to their size and the size of the display panels.

FIG. 7D is a back view of the panels 12 and 14. These duplicate panels have two female dove tail slots (16A and 18A as shown) extending from near the top corners of the panels (16 and 18 as shown) which lock and slide down the to male dove tail fingers 33 on the upper edges of the angled portions at left and right of the two support brackets (28 and 32). The bottom edges 26 of the panels 12 and 14 seat into slots 40 located at the upper side edges of the bottom base support 38. The central gaps 28B, 32B in the construction of the two support brackets 28 and 32 can vary in length (as determined by the width of bottom base support 38) and width to accommodate an unlimited quantity of sheet goods for viewing.

FIG. 7E is a plan view of bottom base support panel (38). Panel 38 has a substantially rectangular shape having chamfered side edges 38A of approximately 45 degrees on both upper sides which extend the length of the panel. On the left and right upper sides are two female slots 40 which also extend the length of the panel. The bottom panel 38 also has four small horizontal cutouts 42 in the sides (approximately midway along the length of the panel) that mate with the upper edges of both support brackets (28 and 32) for alignment and added support. The two female slots 40 face upward so that the four cutouts (42) lie across the two support brackets (28 and 32).

FIGS. 8A through 8E illustrate a "HALF DOME" assembled art bin 90 comprising seven pieces, the components themselves and their assembly to complete the art bin. In this embodiment, the tops of the display panels feature compound curves for esthetic reasons. The display panels had have any suitable shape which will adequately support the art to be displayed, including substantially rectangular or trapezoidal overall or having upper edges which are curved, semicircular, serrated, crenellated or any configuration which is functional and esthetically please.

Figure 8A:
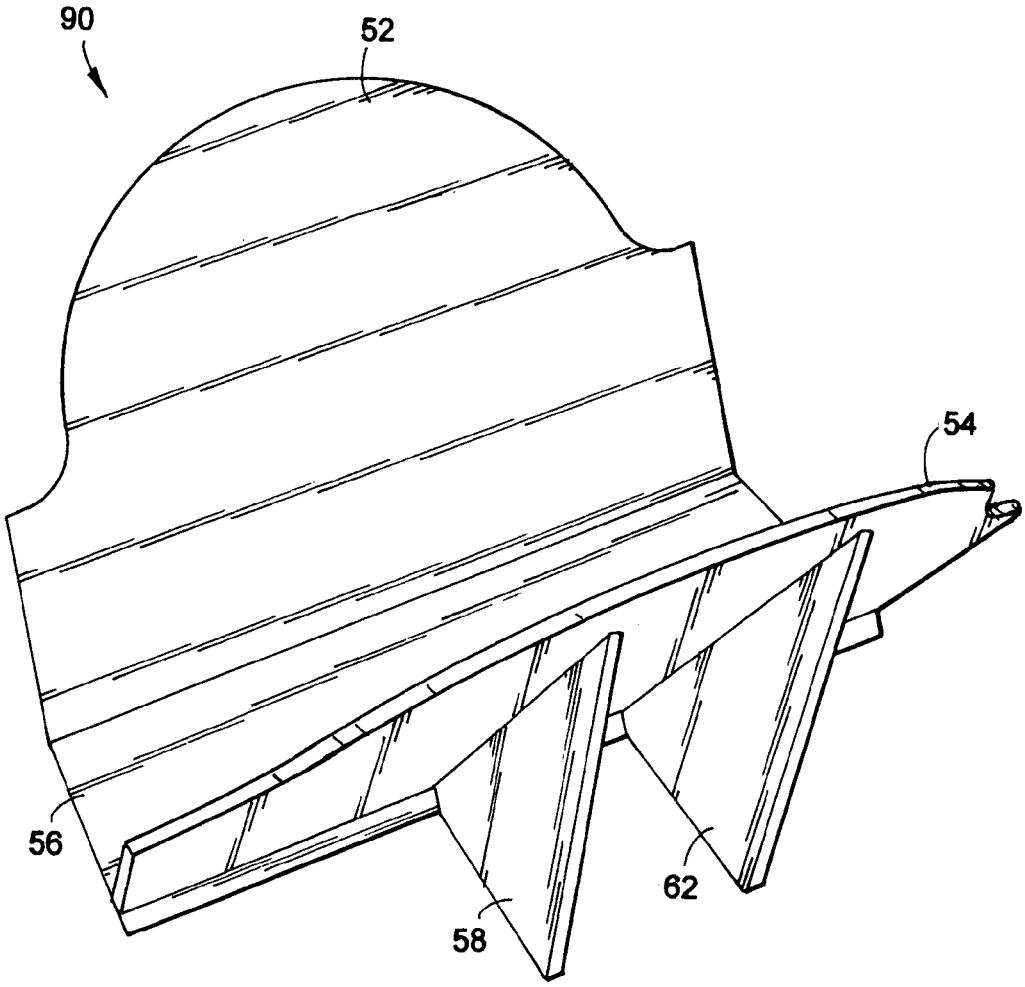
FIG. 8A is a side perspective view of an assembled art bin with "Half Dome" shaped display panels.

FIG. 8A is a side perspective view of an assembled art bin 90 in which two "Half Dome" shape panels 52 and 54 support the art or other sheet goods for viewing. On the back sides of both panels are two female dove tail slots (68,74) and (72,76) (shown in detail in FIG. 8C) spaced at equal distances from the center of the panel and traveling the vertical length of the panel starting at the bottom and stopping at a predetermined distance from the top. The two vertical female dove tail slots mate with male dove tail fingers 33 on the upper edges of separate triangular support brackets (58,62) and (64,66), as discussed above the previous embodiments and illustrated, e.g. in FIG. 7C. The distance between the two female dove tail slots on the backsides of both panels vary according to the sizes of the panels. The bottom panel 56 has chamfered edges 78 along the left and right sides, as seen in FIG. 8D. The bottom panel's upper surface has two female dove tail slots (82 and 84) that travel the length of the panel along the left and right sides.

Figure 8B:
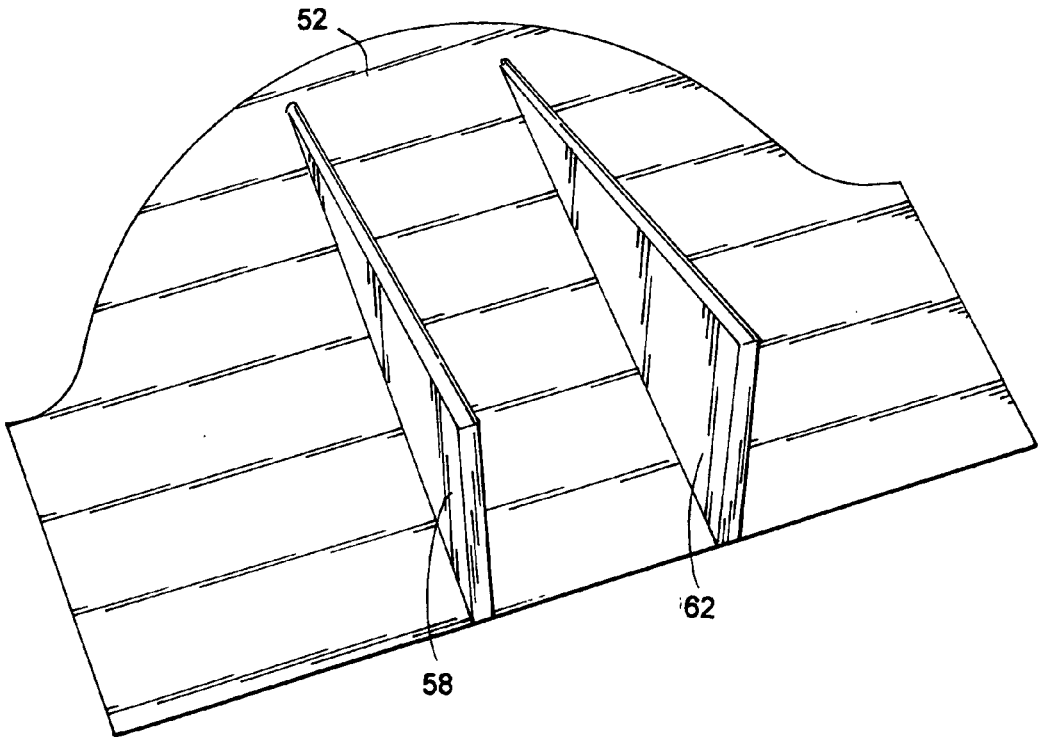
FIG. 8B is a top perspective view of the backside of one of the display panels with support brackets installed.

FIG. 8B is a top perspective view of the backside of one of the display panels with support brackets installed. Here, the angled portions of support brackets 58 and 62 have been inserted into the dove tail grooves in panel 52 to form a dove tail joint. As with earlier embodiments, the four support brackets (58,62) and (64,66) are of individual one-piece construction and having the form of a right triangle to support the panels 52 and 54.

These four angled support brackets each have a male dovetail leading edge 33 that slides into the female dove tail slots on the backsides of the two display panels. The acute angles at the bases of the support brackets are selected to provide the desired inclination of the panels in the assembled art bin.

Figure 8C:
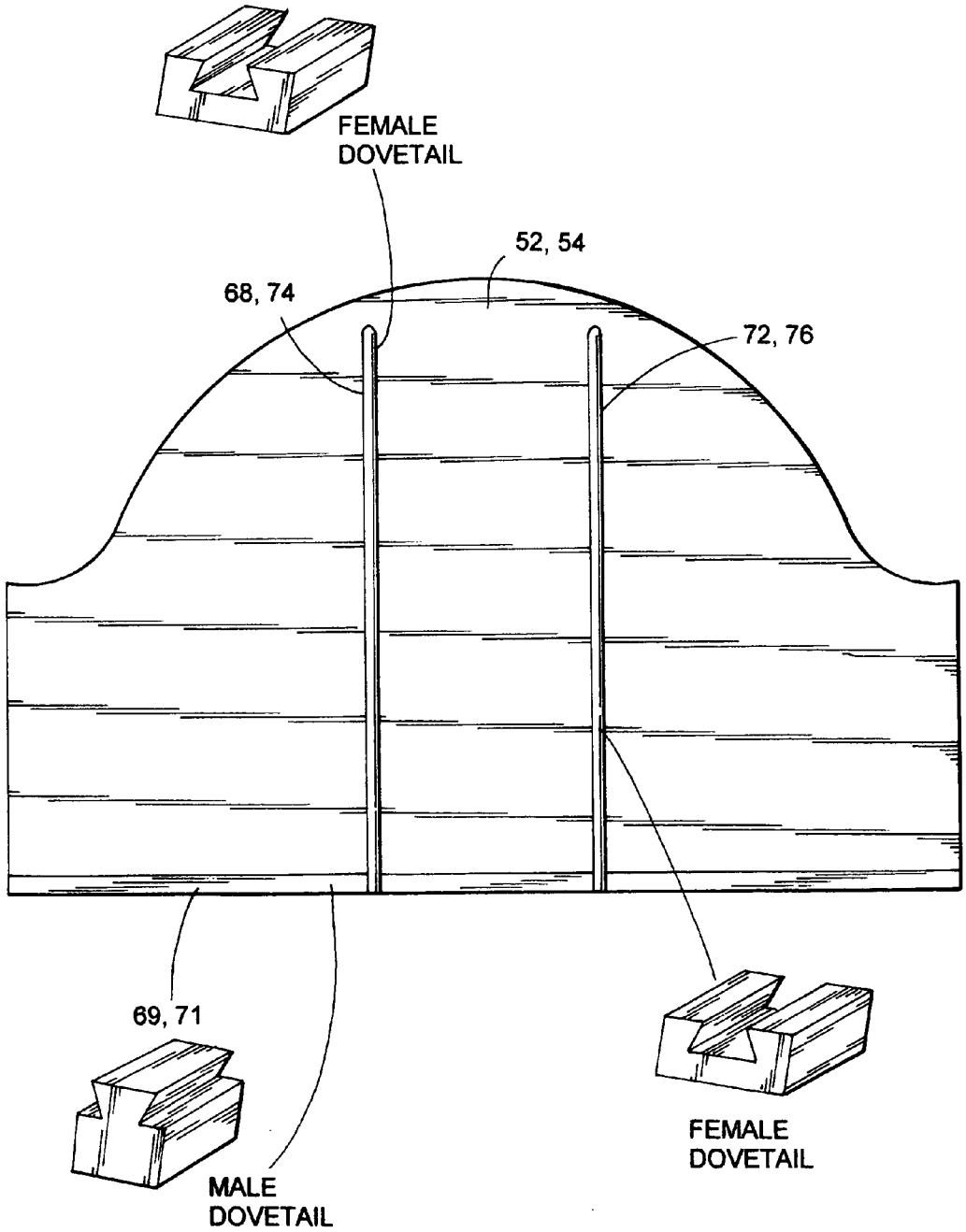
FIG. 8C is a plan view of the backsides of display panels 52 and 54 showing dovetail slots therein.
Figure 8D:
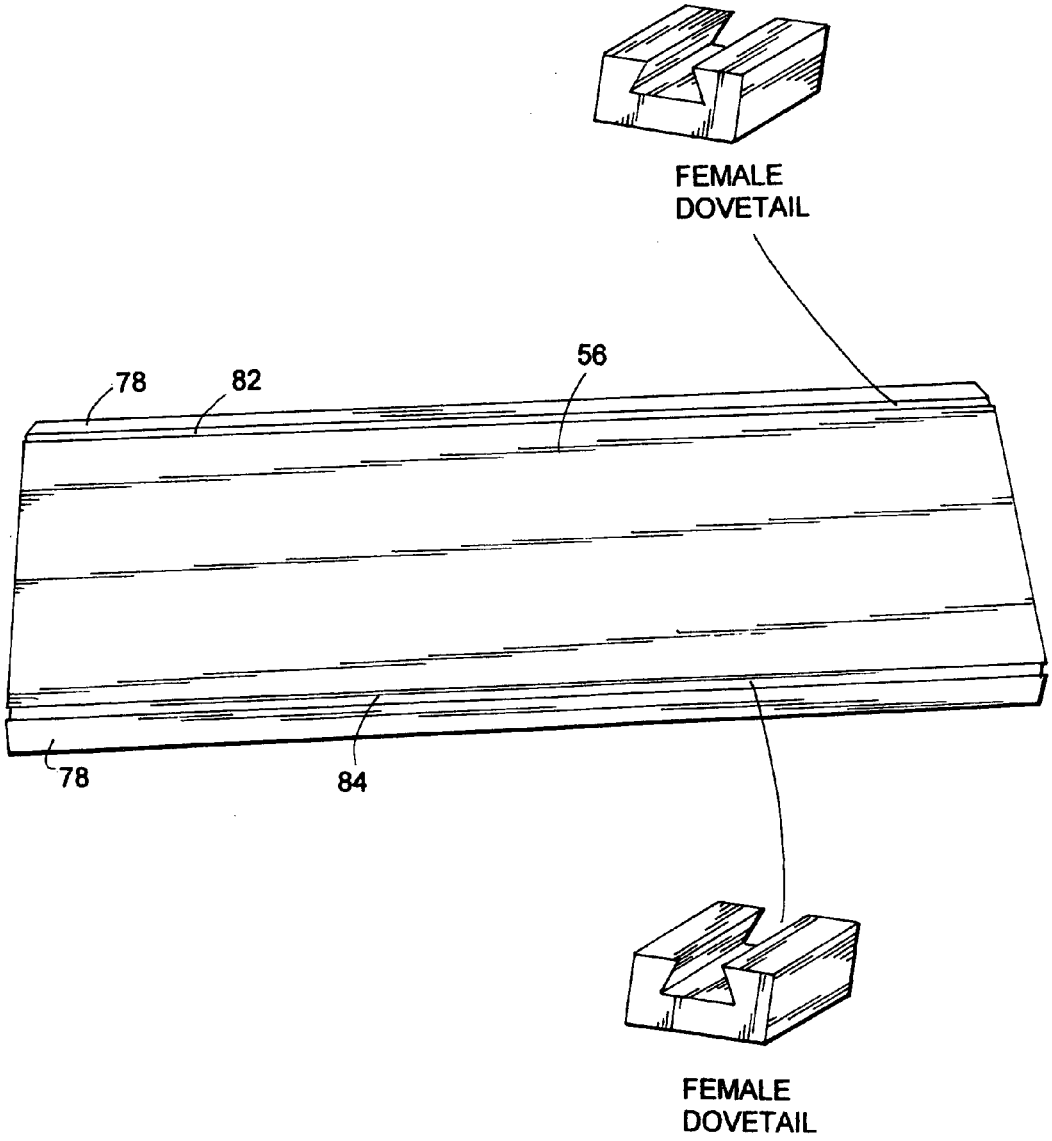
FIG. 8D is an overhead perspective view of bottom panel 56.

FIG. 8C is an elevation view of the backside of display panels 52 and 54, showing the pairs of female dove tail slots (68,74) and (72,76) which slide down the male dove tail fingers along the leading edges 58A et al. of the support brackets 58 et al. The bottoms 26 of the display panels 52 and 54 also have male dove tail fingers 33 protruding along the bottom edge. These male dove tail fingers 33 slide into the two female dove tail slots (82 and 84) located at the base support 56 upper edges on the left and right. The distance between the two female dove tail slots varies according to the size of the bottom panels. Chamfered lower edges are indicated by 69 and 71.

FIG. 8D is an overhead perspective view of bottom base panel 56. Bottom base panel 56 has a substantially rectangular shape, having two chamfered horizontal edges 78 of approximately 45 degrees extending the length of the panel. This panel has a smooth finish on the bottom so that it lies flat on a surface. Two female dove tail slots (82 and 84) are located the base support's (56) upper surface near the edges to the left and right. These two dove tail slots are designed and positioned to support the display panels at approximately the desired acute angle to the horizontal. The distance between these two female dove tail slots varies according to the width of the bottom panel.

Figure 8E:
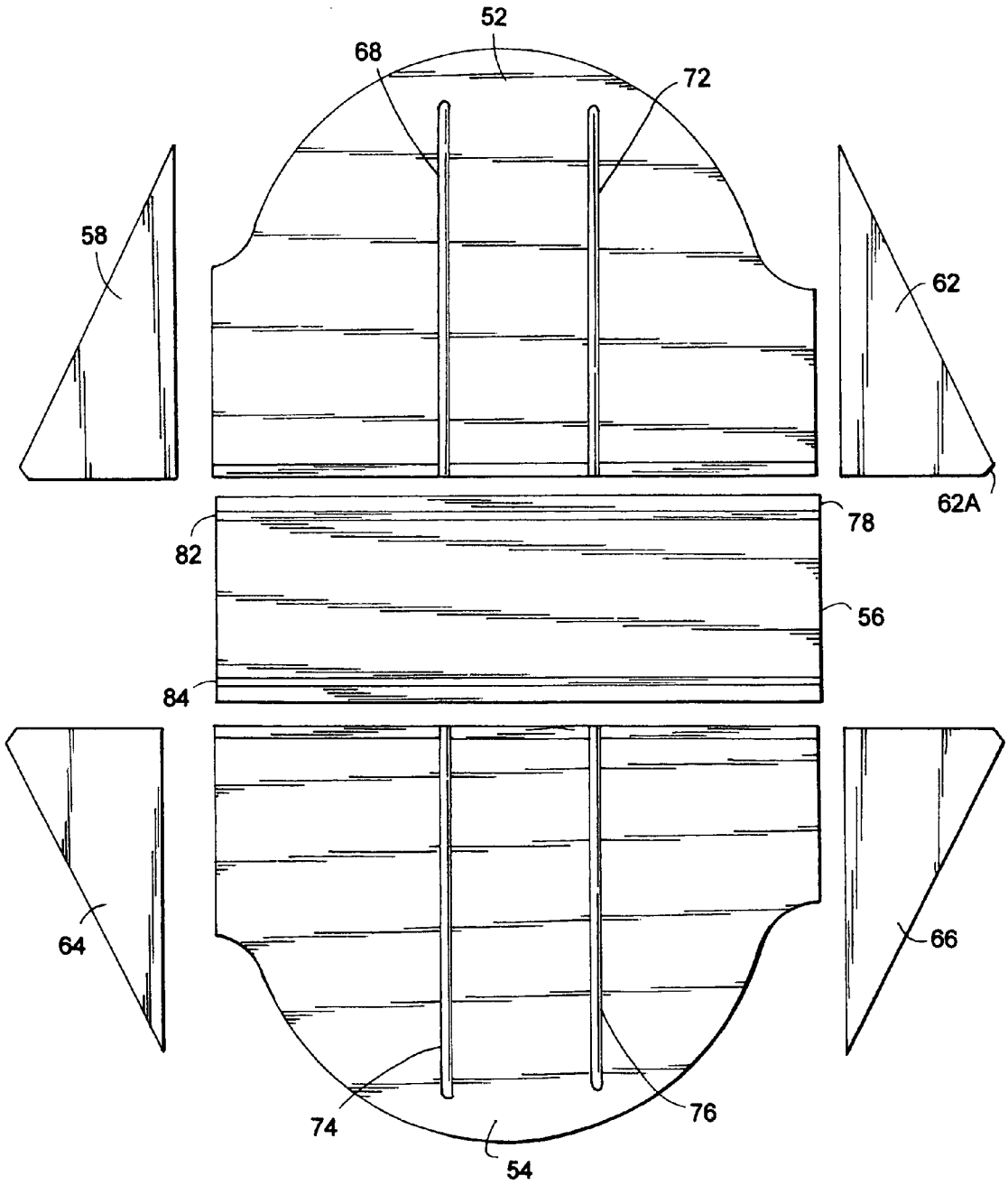
FIG. 8E is an overall top plan view of the seven pieces making up the art bin of FIG. 8A.

FIG. 8E is an overall top plan view of the total of seven pieces that make up this embodiment of the art bin. Main display panels 52 and 54 support the art or other sheet goods for viewing or storage. Shown on the backsides of panels 52 and 54 are two pairs of female dove tail slots, as described above with regard to FIG. 8C. Support brackets (58,62,63 and 66) each have male dove tail fingers 33 located on the angled upper edges as described above with regard to FIG. 8B. Optionally, the lower corners of these support brackets can be cut off at approximately 45 degree angles, as shown at 62A, to enable the brackets to fit flush with bottom base panel 56. This provides added support for the panels and improves the stability of the assembled unit. The bottom base panel 56 is as described in detail above with regard to FIG. 8D.

Various changes and modifications to the presently preferred embodiments will be apparent to those skilled in the art. Such changes and modifications may be made without departing from the spirit and scope of the present invention and without diminishing its attendant advantages. Therefore, the appended claims are intended to cover such changes and modifications, and are the sole limits on the scope of the invention.

I claim:

1. A collapsible display bin for display of sheet goods, comprising a rectangular, flat bottom panel and first and second display panels having designated upper and lower edges and upper and lower surfaces and support means for maintaining said display panels in positions wherein said panels are each inclined at acute angles in a range of from about 40 to about 55 degrees from the horizontal, and are thereby capable of displaying the sheet goods effectively on at least one of said display panels while creating a stable structure with open ends, with said lower surfaces of said display panels including an obtuse angle therebetween, wherein the lower edges of said display panels are adapted to be removably attached to said bottom panel by insertion of their lower edges into slots along the longitudinal edges of said bottom panel and wherein said support means comprise two substantially triangular angled vertical support brackets collapsibly attached to the lower surfaces of each of said display panels.

2. The display bin of claim 1 wherein said angled vertical support brackets support said panels when extended in a direction approximately perpendicular to said lower surfaces of said panels.

3. The display bin of claim 1 wherein said support brackets each comprise first and second angled upper edge portions to support said display panels.

4. The display bin of claim 3 wherein the angled upper edge portions of said support brackets are separated by a connecting portion having a horizontal edge substantially parallel to the lower edges of said brackets to support said bottom panel and said display panels with their lower edges separated to provide additional space for supporting sheet goods.

5. The display bin of claim 1 wherein said slots in said bottom panel are female dovetail slots and wherein said first and second display panels have male dovetail fingers cut on the lower edges thereof, adapted for insertion into said female dovetail slots in said bottom panel in said bottom panel by sliding.

6. The display bin of claim 3 wherein said support brackets are attached to the lower surfaces of said display panels by insertion of the angled upper edges of said brackets into slots in said lower surfaces of said display panels.

7. The display bin of claim 6 wherein said edges and said slots of said support brackets, said display panels and said bottom panel are interconnected by dovetail finger joints to form a stable structure.

8. A collapsible display bin for display of sheet goods, comprising:

a rectangular flat bottom panel, first and second display panels, each having designated upper and lower edges and surfaces, which lower edges are adapted to be removably attached to said bottom panel, and two support bracket assemblies, each having two opposite-facing angled upper edge portions for supporting said display panels at acute angles in the range of from about 40 to about 55 degrees from the plane of said bottom panel, with horizontal edges defining a connecting portion separating said angled upper edge portions and supporting said bottom panel, wherein said lower edges of said display panels are adapted to be attached to said bottom panel by their insertion into slots along the longitudinal edges of said bottom panel, and the lower surfaces of said display panels and said angled upper edge portions of said support bracket assemblies are removably interconnected by dovetail finger joints, thereby forming a stable structure with open ends.

9. The display bin of claim 8, wherein said angled upper edge portions of said support bracket assemblies comprise male dovetail fingers which are adapted for insertion into corresponding female dovetail slots in the lower surfaces of each of said first and second display panels.

10. The display bin of claim 8 wherein said lower edges of said display panels comprise male dovetail fingers and said slots of said bottom panel are female dovetail slots.

* * * * *